US007073627B2

(12) United States Patent
Casebolt et al.

(10) Patent No.: US 7,073,627 B2
(45) Date of Patent: Jul. 11, 2006

(54) DORSAL PAD ASSEMBLY FOR USE WITH A SAFETY HARNESS

(75) Inventors: Scott C. Casebolt, St. Paul Park, MN (US); J. Thomas Wolner, Red Wing, MN (US)

(73) Assignee: D B Industries, Inc., Red Wing, MN (US)

( * ) Notice: Subject to any disclaimer, the term of this patent is extended or adjusted under 35 U.S.C. 154(b) by 294 days.

(21) Appl. No.: 10/821,027

(22) Filed: Apr. 8, 2004

(65) Prior Publication Data

US 2005/0067222 A1 Mar. 31, 2005

Related U.S. Application Data

(60) Provisional application No. 60/500,597, filed on Sep. 5, 2003.

(51) Int. Cl.
*A62B 35/00* (2006.01)

(52) U.S. Cl. ..... 182/3; 119/770

(58) Field of Classification Search ..... 182/3–7, 182/36; 244/151 R; 119/96, 857, 770
See application file for complete search history.

(56) References Cited

U.S. PATENT DOCUMENTS

| | | | | |
|---|---|---|---|---|
| 3,102,316 | A * | 9/1963 | Cadley | 24/650 |
| 3,424,134 | A * | 1/1969 | Rosenblum | 182/3 |
| 4,738,413 | A * | 4/1988 | Spinosa et al. | 244/151 R |
| 5,203,829 | A * | 4/1993 | Fisk et al. | 119/857 |
| 5,531,292 | A | 7/1996 | Bell | |
| 5,697,329 | A * | 12/1997 | Bell et al. | 119/857 |
| 6,006,860 | A * | 12/1999 | Bell | 182/18 |
| 6,253,874 | B1 | 7/2001 | Casebolt et al. | |
| 6,330,931 | B1 * | 12/2001 | Baillargeon et al. | 182/18 |
| 6,691,824 | B1 * | 2/2004 | Sharp | 182/3 |
| 6,959,784 | B1 * | 11/2005 | Diggle et al. | 182/9 |

FOREIGN PATENT DOCUMENTS

| | | |
|---|---|---|
| EP | 0 557 031 A1 | 8/1993 |
| WO | WO/98/32364 | 7/1998 |

* cited by examiner

*Primary Examiner*—Hugh B. Thompson, II
(74) *Attorney, Agent, or Firm*—IPLM Group, P.A.

(57) ABSTRACT

A preferred embodiment safety harness includes two straps operatively connected to a D-ring, which is operatively connected to a biasing mechanism urging the D-ring to an upright position. The safety harness may also include an impact indicator for providing indication when the D-ring has been subjected to a force and a wear pad for reducing wear on the straps of the safety harness.

41 Claims, 28 Drawing Sheets

FIG. 14
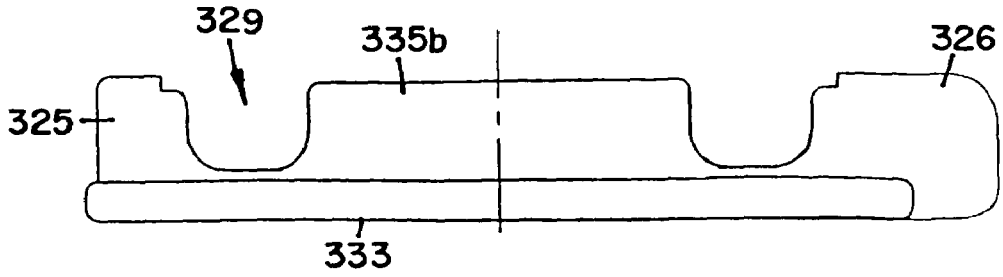
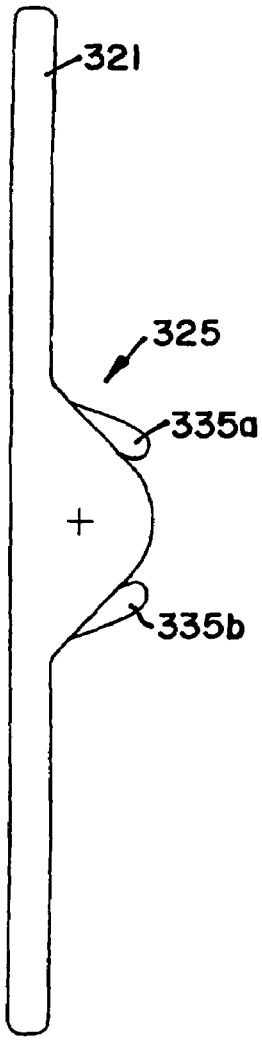
FIG. 15
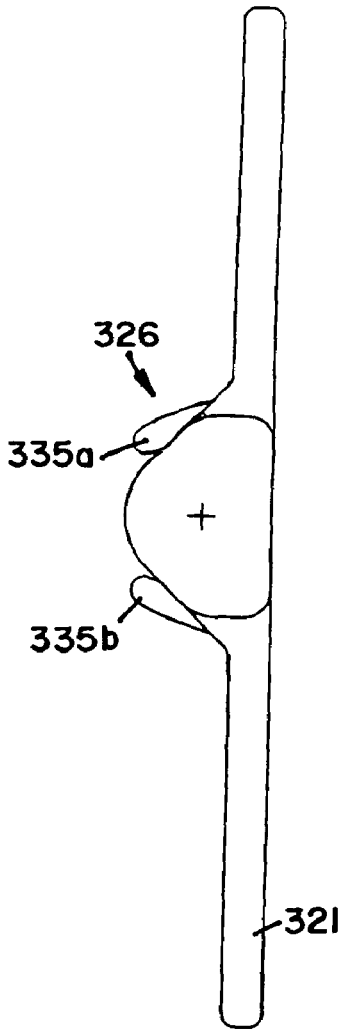
FIG. 16

FIG. 28
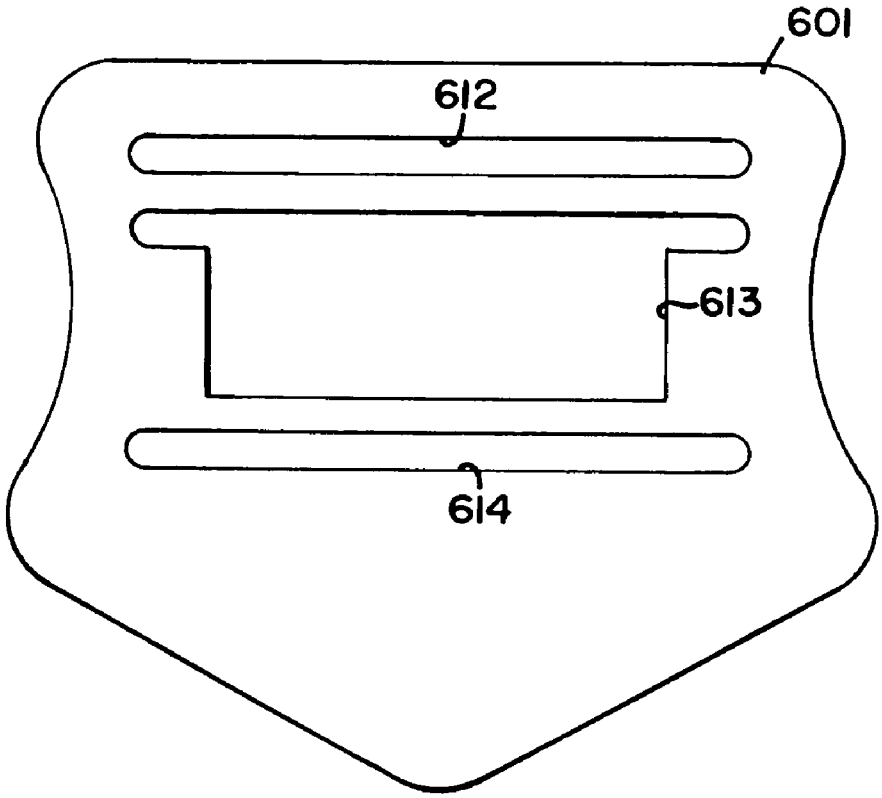
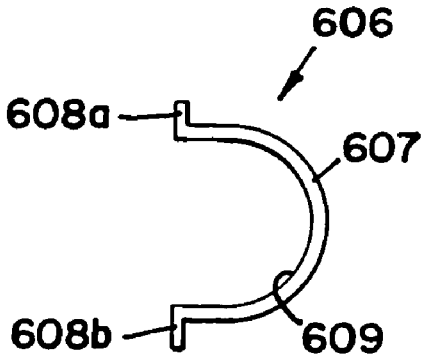
FIG. 29

FIG. 41
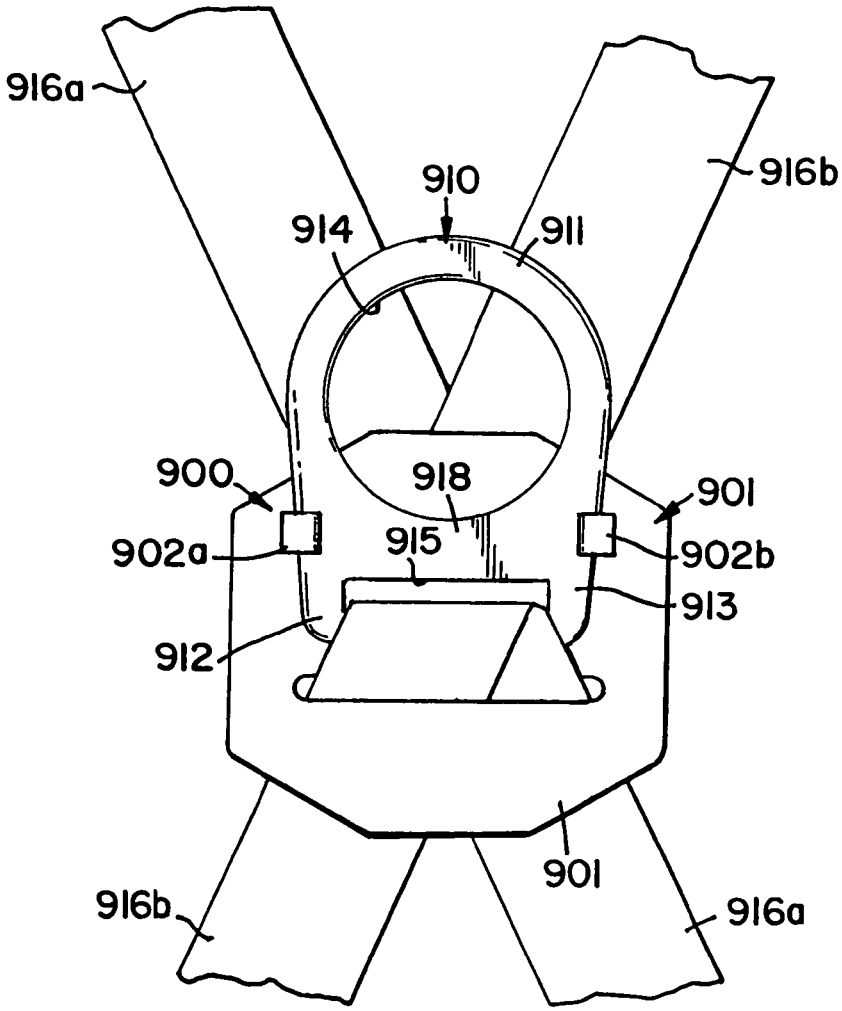
FIG.42
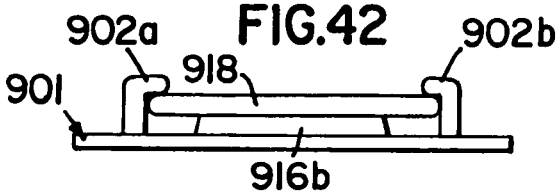
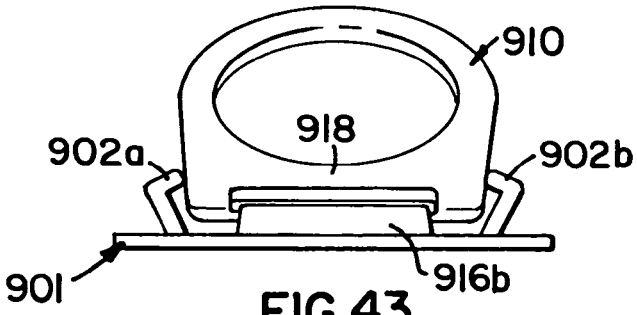
FIG.43

DORSAL PAD ASSEMBLY FOR USE WITH A SAFETY HARNESS

This application claims the benefit of U.S. Provisional Application No. 60/500,597, filed Sep. 5, 2003.

BACKGROUND OF THE INVENTION

1. Field of the Invention

The present invention relates to a safety harness and components thereof.

2. Description of the Prior Art

Various occupations place people in precarious positions at relatively dangerous heights thereby creating a need for fall-arresting safety apparatus. Among other things, such apparatus usually include a safety line interconnected between a support structure and a person working in proximity to the support structure. The safety line is typically secured to a full-body safety harness worn by the worker. Obviously, such a harness must be designed to remain secure about the worker in the event of a fall. In addition, the harness should arrest a person's fall in as safe a manner as possible, placing a minimal amount of strain on the person's body. Yet another design consideration is to minimize the extent to which people may consider the harness uncomfortable and/or cumbersome.

In addition, there is a need for a more user-friendly safety harness. For example, it is often difficult and/or cumbersome to connect the safety harness to a safety line. Further, once a safety harness has been subjected to forces from a fall, the safety harness must be discarded. It is often difficult to determine whether a safety harness has been subjected to forces from a fall or an impact.

SUMMARY OF THE INVENTION

In a preferred embodiment safety harness, the safety harness includes a first strap, a second strap, a D-ring, and a biasing mechanism. The D-ring is operatively connected to the straps and has a first position and a second position. The first position is an upright receiving position, and the second position is a connected operating position. The biasing mechanism is operatively connected to the D-ring, and the biasing mechanism urges the D-ring to the first position.

In another preferred embodiment safety harness, the safety harness includes a first strap, a second strap, a D-ring, and an impact indicator. The D-ring is operatively connected to the straps, and the impact indicator is operatively connected to the D-ring. The impact indicator provides indication when the D-ring has been subjected to a force.

In a preferred embodiment safety harness having a first strap and a second strap, a D-ring is operatively connected to the straps. The D-ring has a first position and a second position. The first position is an upright receiving position, and the second position is a connected operating position. The safety harness also includes means for urging the D-ring to the first position.

In a preferred embodiment dorsal pad assembly for use with a safety harness having a first strap and a second strap, a D-ring is operatively connected to the straps. The D-ring has a first position and a second position. The first position is an upright receiving position, and the second position is a connected operating position. A biasing mechanism is operatively connected to the D-ring, and the biasing mechanism urging the D-ring to the first position. An impact indicator is operatively connected to the D-ring, and the impact indicator provides indication when the D-ring has been subjected to a force.

In a preferred embodiment dorsal pad assembly for use with a safety harness including straps, a D-ring has a bar portion, a first position, and a second position. The first position is an upright receiving position, and the second position is a connected operating position. A D-ring clip has a cavity, and the bar portion of the D-ring is positioned within the cavity and is engaged by the D-ring clip. A dorsal pad has slots and a D-ring connector portion. The straps of the harness are routed through the slots, and the D-ring connector portion has a second cavity. The D-ring clip is positioned within the second cavity and is engaged by the dorsal pad. A biasing mechanism interconnects the D-ring clip and the dorsal pad, and the biasing mechanism applies a force on the D-ring clip thereby urging the D-ring to the first position. When the D-ring is placed in the second position, the biasing mechanism urges the D-ring to the first position.

In a preferred embodiment method of securing a safety harness donned by a user to a connector of a safety device, a D-ring operatively connected to straps of the safety harness is constantly urged to an upright position relative to the user. The D-ring has a first position and a second position. The first position is an upright receiving position, and the second position is a connected operating position. The connector of the safety device is secured to the D-ring in the upright receiving position.

In another preferred embodiment dorsal pad assembly for use with a safety harness having a first strap and a second strap, a D-ring is operatively connected to the straps and has a first position and a second position. The first position is an upright receiving position, and the second position is an impact indicator position. A mechanism is operatively connected to the dorsal pad assembly, and the mechanism substantially holds the D-ring in the first position and allows the D-ring to be in the second position when the D-ring has been subjected to a force.

In another preferred embodiment dorsal pad assembly for use with a safety harness having a first strap and a second strap, a D-ring is operatively connected to the straps and has a first position and a second position. The first position is an upright receiving position, and the second position is an impact indicator position. The dorsal pad assembly also includes means for substantially holding the D-ring in the first position and allowing the D-ring to be in the second position when the D-ring has been subjected to a force.

BRIEF DESCRIPTION OF THE DRAWINGS

FIG. 14 is a front side view of the D-ring connector shown in FIG. 10;

FIG. 15 is a left side view of the D-ring connector shown in FIG. 10;

FIG. 16 is a right side view of the D-ring connector shown in FIG. 10;

FIG. 28 is a front view of a dorsal pad for use with the dorsal D-ring assembly shown in FIG. 26;

FIG. 29 is a side view of a wear pad for use with the dorsal D-ring assembly shown in FIG. 26;

FIG. 41 is a front view of a D-ring clip and fall indicator constructed according to the principles of the present invention;

FIG. 42 is a bottom view of the D-ring clip and fall indicator shown in FIG. 41; and FIG. 43 is a bottom view of the D-ring clip and fall indicator shown in FIG. 41 after the D-ring clip and fall indicator has been subjected to an impact.

DETAILED DESCRIPTION OF A PREFERRED EMBODIMENT

Figure 1:
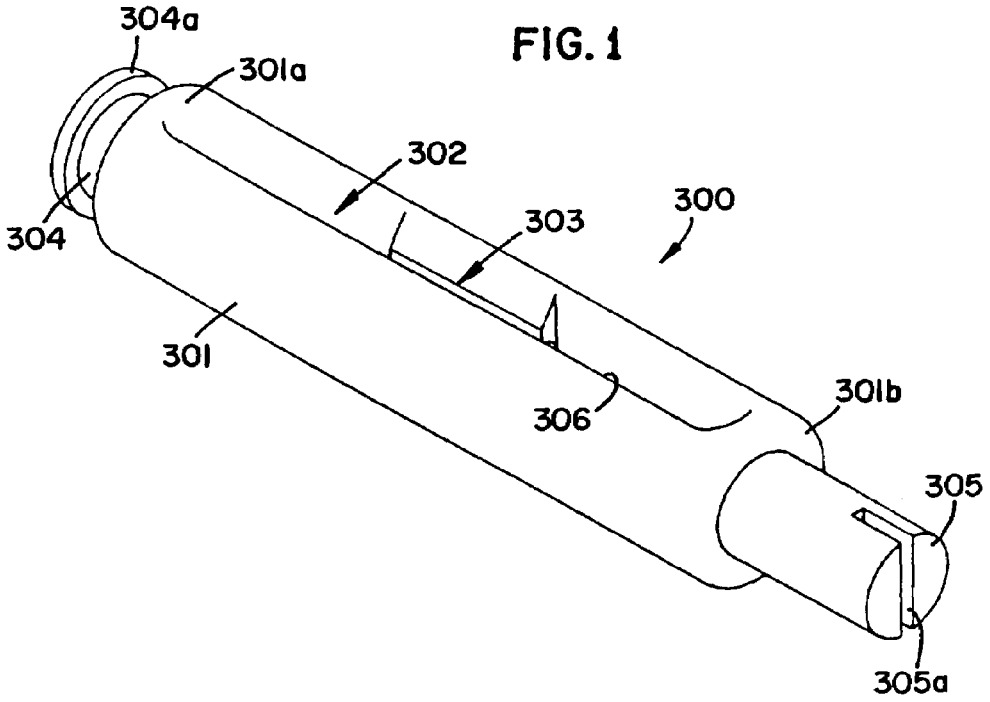
FIG. 1 is a perspective view of a D-ring clip and impact indicator constructed according to the principles of the present invention.
Figure 2:
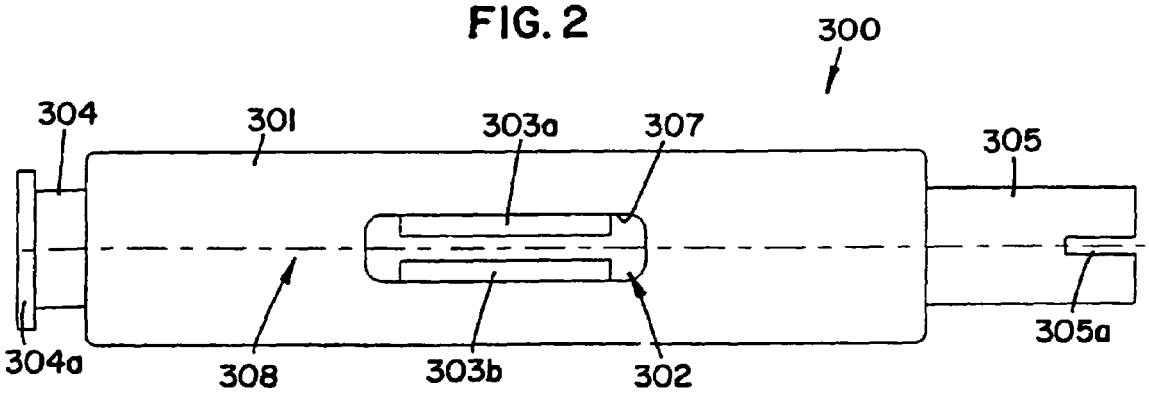
FIG. 2 is a bottom view of the D-ring clip and impact indicator shown in FIG. 1.
Figure 3:
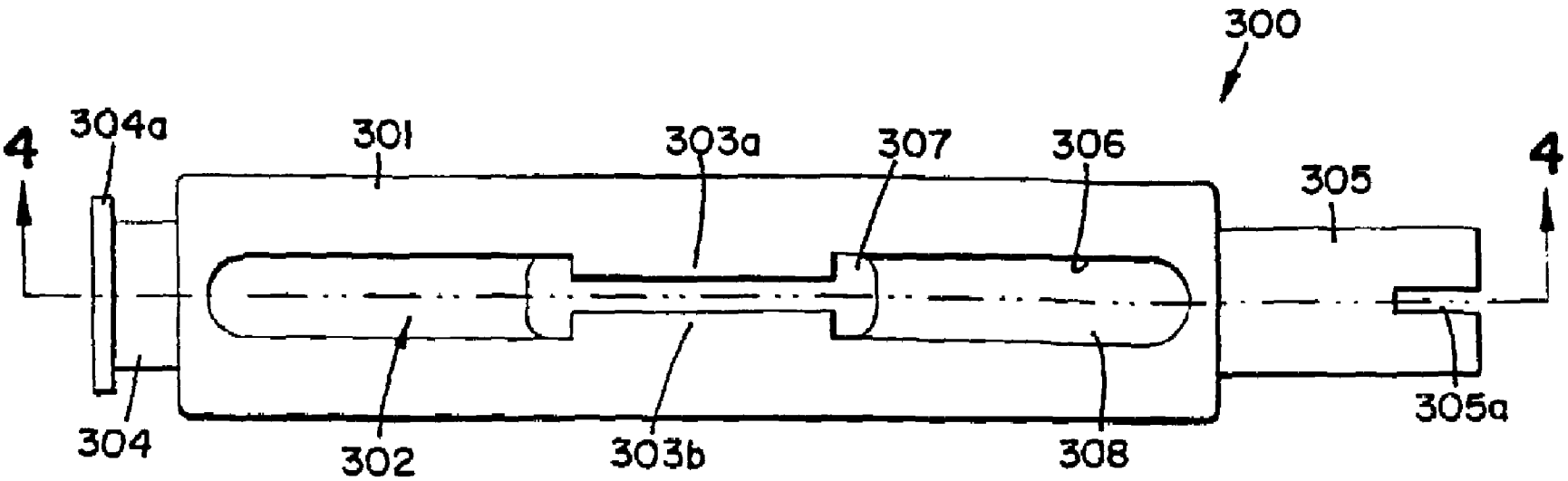
FIG. 3 is a top view of the D-ring clip and impact indicator shown in FIG. 1.
Figure 4:
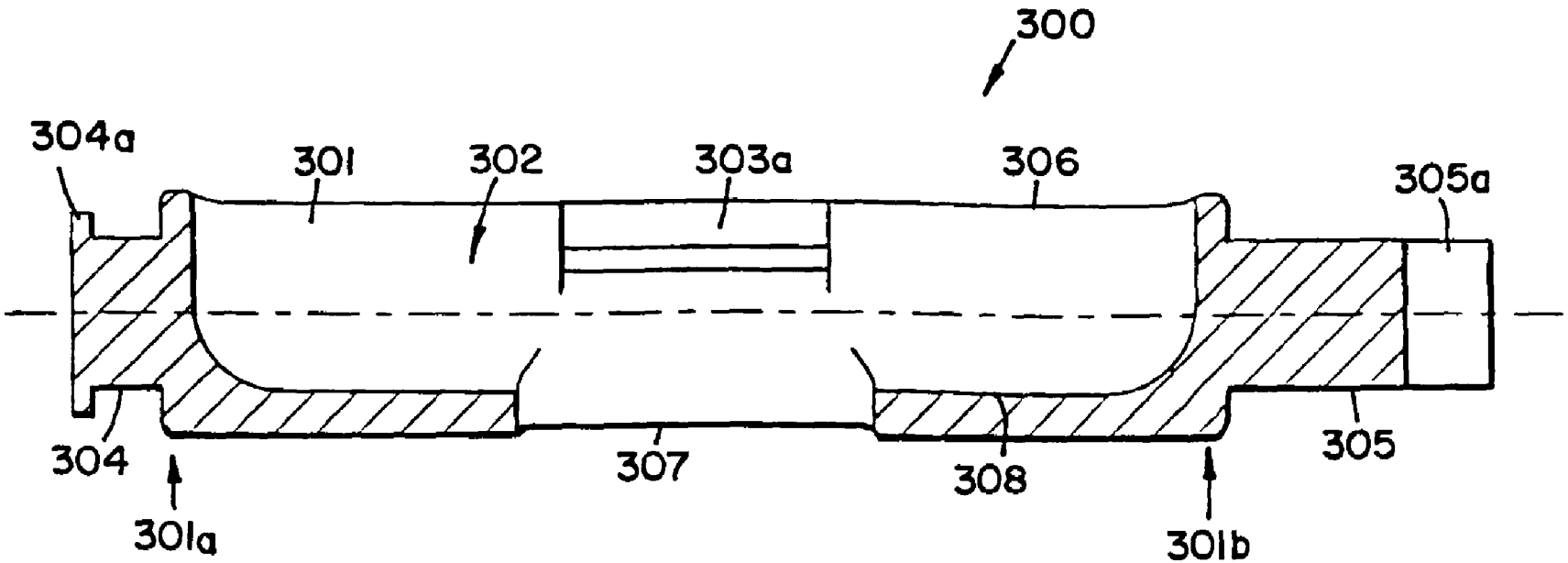
FIG. 4 is a cross-sectional side view of the D-ring clip and impact indicator shown in FIG. 1 along the lines 4—4 shown in FIG. 3.
Figure 5:
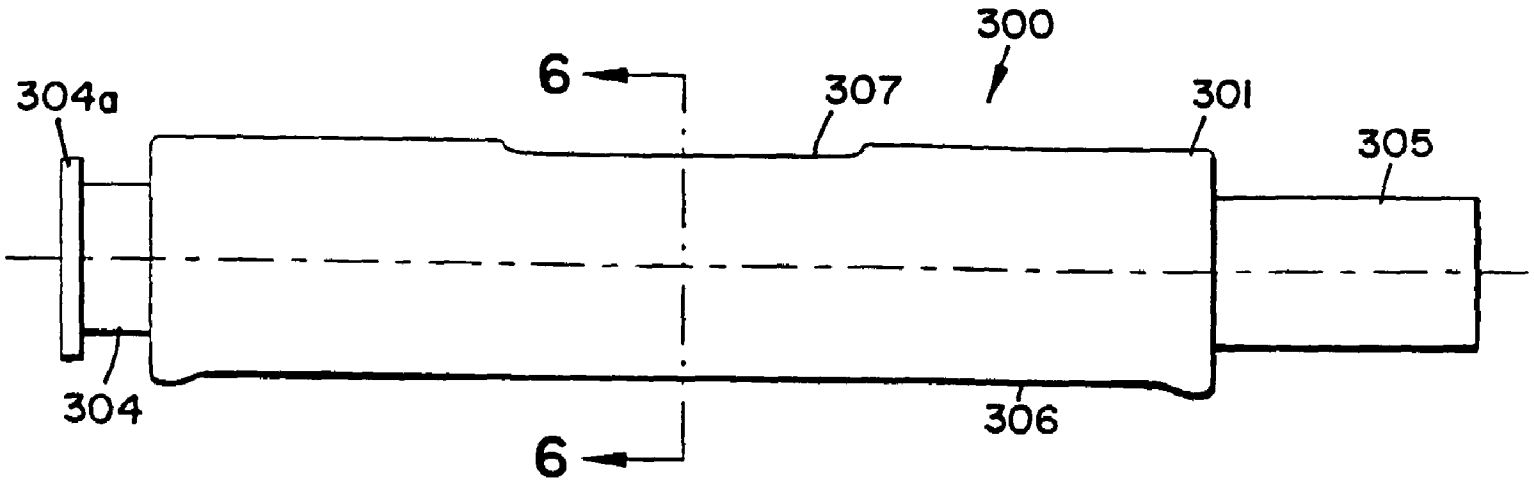
FIG. 5 is a side view of the D-ring clip and impact indicator shown in FIG. 1.

Preferred embodiment safety harnesses and components thereof constructed according to the principles of the present invention are shown in the drawings, wherein like numerals represent like components throughout the drawings.

Access to a safety harness and an indication whether a safety harness has been subjected to the force of an impact are among the important features of a safety harness. A dorsal D-ring positioned upright relative to the user and/or the dorsal pad upon which it is operatively connected assists in quickly and easily connecting to a lifeline, a lanyard, a D-ring extension, a shock absorber, a winch, a rope grab, a descent device, or other safety device well known in the art. A carabiner, a snap hook, or other connector well known in the art is typically used to connect the safety device to the D-ring of the safety harness.

A biasing mechanism operatively connected to the D-ring to urge the D-ring in an upright position could be used to assist in quickly and easily connecting to a lifeline. The biasing mechanism urges the D-ring into a first position, which is a receiving upright position. The biasing mechanism preferably places a constant force upon the D-ring that may be overcome during use of the D-ring. During use of the D-ring, the D-ring moves in a second position, which is a connected position that varies with the movement of the user and/or the lifeline connected to the D-ring. The second position may include the first position during use of the D-ring. When the D-ring is not being urged in the second position by a lifeline or another device, the D-ring is urged in the first position by the biasing mechanism. Because the lifeline is attached to the D-ring, an indicator operatively connected to the D-ring would be helpful in determining whether the safety harness has been subjected to an impact, in which case the safety harness should be discarded.

Alternatively, a mechanism for holding the D-ring in a first position and allowing the D-ring to be in a second position when the D-ring has been subjected to a force could be used. In this instance, the first position is an upright receiving position, and the second position is an impact indicator position. The mechanism could be a biasing mechanism or a clip mechanism, and the D-ring is substantially held in the first position by the mechanism. When an impact has occurred, the mechanism will allow the D-ring to be in the second position from the force of the impact upon the D-ring thereby providing visual indication that the D-ring has been subjected to a force.

Figure 6:
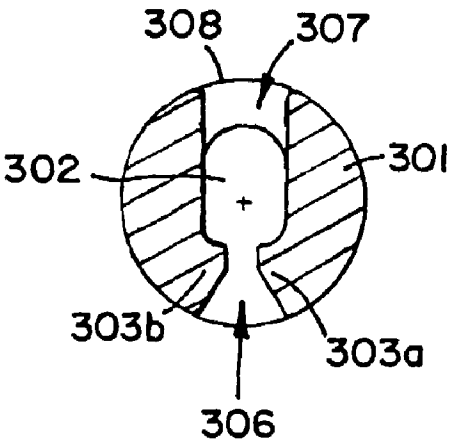
FIG. 6 is a cross-sectional view of the D-ring clip and impact indicator shown in FIG. 1 along the lines 6—6 shown in FIG. 5.
Figure 7B:
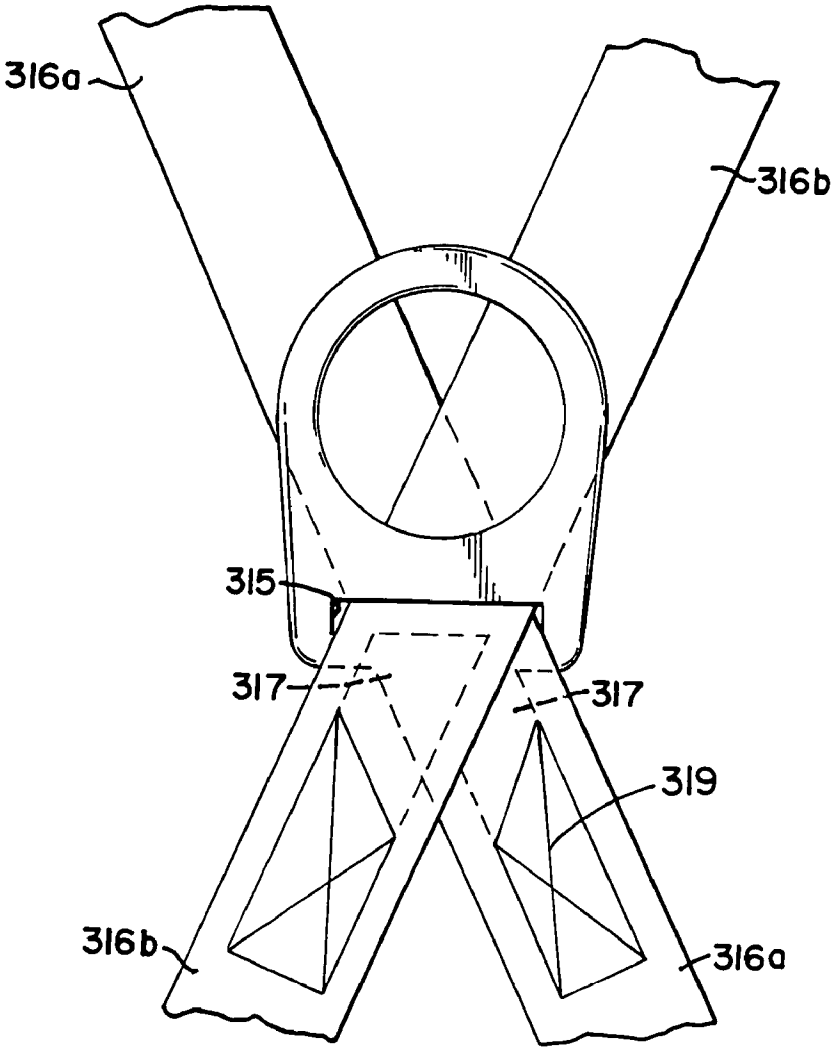
FIG. 7B is a front view of the D-ring shown in FIG. 7A engaging straps of a safety harness.
Figure 7A:
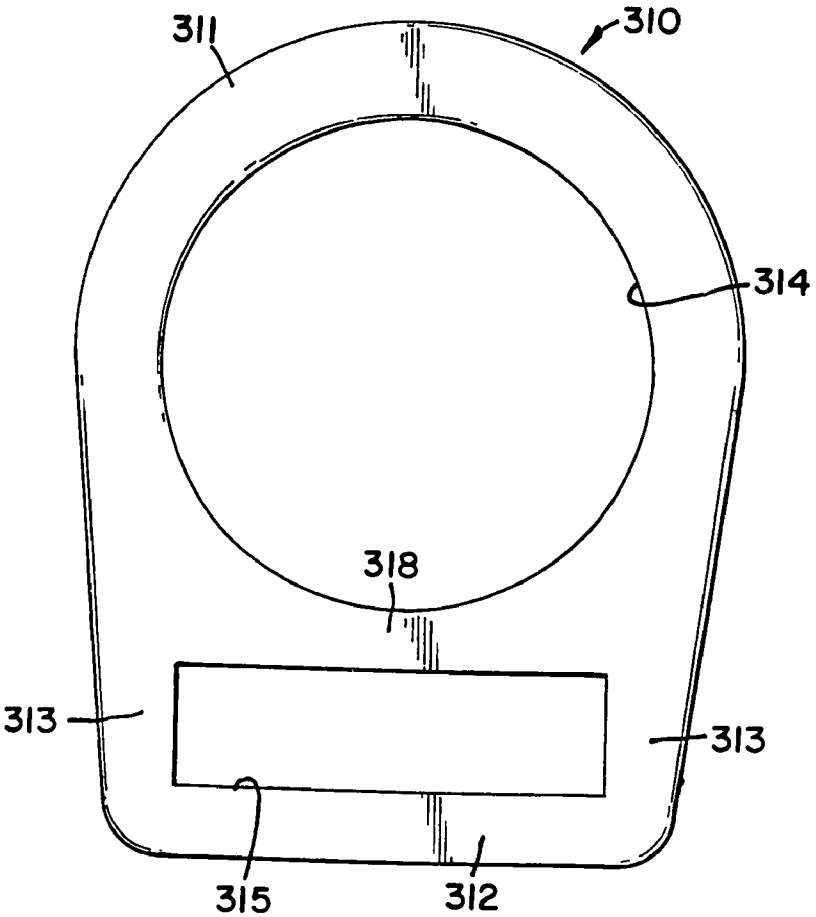
FIG. 7A is a front view of a D-ring.

A preferred embodiment D-ring clip and impact indicator 300 is shown in FIGS. 1–6, and a typical D-ring 310 for use with the D-ring clip and impact indicator 300 is shown in FIG. 7A. A preferred embodiment combination dorsal pad, D-ring connector, and impact indicator 320, hereinafter assembly 320, is shown in FIGS. 8–19, and is configured and arranged for use with the D-ring clip and impact indicator 300.

The D-ring 310 includes a ring portion 311 and a bar portion 312, which are interconnected with connecting portions 313 on both sides forming an opening 315 therebetween. The ring portion 311 includes an opening 314 to which a connector may be attached. Between the openings 314 and 315 is an intermediate portion 318. Straps 316*a* and 316*b* are threaded through the opening 315 of the D-ring 310 and preferably overlap and criss-cross in divergent fashion, as shown in FIG. 7B, to form the shoulder straps and back straps of the harness. A third strap 317 may be optionally attached at one end to the back of strap 316*a*, threaded through the opening 315 of the D-ring 310, and then attached at the other end to the back of the strap 316*b* to fix the D-ring, if desired. The third strap 317 is not used with all styles of safety harnesses and is therefore optional. Stitching 319 may be used to attach the third strap 317 to the straps 316*a* and 316*b*. The D-ring 310 is kept in place between the loop of the third strap 317 and the stitching 319.

The D-ring clip and impact indicator 300, hereinafter referred to as clip 300, is preferably made of nylon type 6—6 and includes a generally cylindrical housing 301 with a first end 301*a*, a second end 301*b*, and a cavity 302 within the housing 301. Operatively connected to the first end 301*a* is a first rounded end 304 with a head 304*a*. The head 304*a* is operatively connected to the end 304 opposite the first end 301*a* and has a larger diameter than the diameter of the end 304. Operatively connected to the second end 301*b* is a second rounded end 305 with a lateral slot 305*a*. The lateral slot 305*a* is opposite the second end 301*b* and extends inward toward the second end 301*b*. The housing 301 also includes a top opening 306 and a bottom opening 307, which provide access to the cavity 302. The top opening 306 is configured and arranged to accept the bar portion 312 of the D-ring 310. The bottom opening 307 is smaller than the top opening 306 and a bottom surface 308 provides a surface upon which the bar portion 312 may rest. Therefore, the bar portion 312 cannot pass through the bottom opening 307.

A friction fitting assembly 303 proximate a center portion of the top opening 306 of the housing 301 includes a first catch 303*a* and a second catch 303*b*. The catches 303*a* and 303*b* are generally triangular protrusions extending partially into the cavity 302. A cross-sectional view of the catches 303*a* and 303*b* is shown in FIG. 6. As shown in FIG. 6, the portions of the catches 303*a* and 303*b* proximate the top of the housing 301 are angled from the top opening 306 into the cavity 302, and the portions of the catches 303*a* and 303*b* proximate the cavity are more horizontal. The angled portion allows the bar portion 312 to slide through the friction fitting assembly 303 into the cavity, and the more horizontal portions provide resistance in removing the bar portion 312 from the cavity 302. In other words, when the bar portion 312 is inserted into the top opening 306, the bar portion 312 forces the catches 303*a* and 303*b* apart to be inserted fully into the cavity 302. The bar portion 312 snaps into place as the bar portion 312 deflects the catches 303*a* and 303*b* away and then the catches 303*a* and 303*b* are deflected back to hold the bar portion 312 in place within the cavity 302 with the catches 303*a* and 303*b*.

With reference to FIGS. 8–19, the assembly 320 is preferably made of urethane. The assembly 320 includes a dorsal pad 321 and a D-ring connector portion 324 operatively connected thereto. The dorsal pad 321 is generally preferably hexagonal and relatively flat in shape and includes four slots 322 and two slots 323, which are configured and arranged to route straps of a safety harness as is well known in the art. A slot 322 extends parallel to each of two adjacent sides at each end of the dorsal pad 321. In other words, there are two slots 322 at each end of the dorsal pad 321, a slot 322 extending parallel to each of the two adjacent sides forming the end. A slot 323 extends perpendicular to the two remaining sides of the dorsal pad 321 approximately ⅓ the length of the dorsal pad 321 from each end. The dorsal pad 321 also includes triangular indentations 328 between the slots 322 and 323 that are optional but add flexibility to the dorsal pad 321. The bottom 333 of the dorsal pad 321 should face the back of the user.

Figure 17:
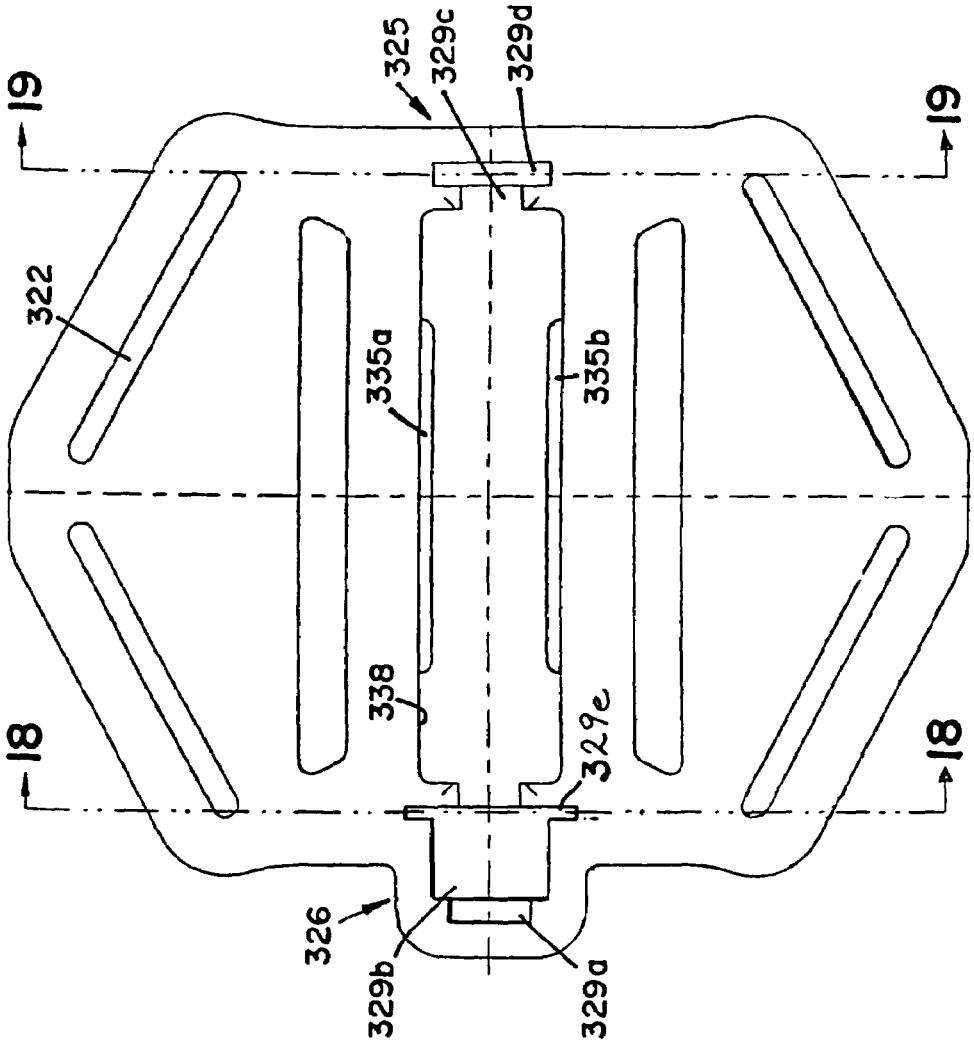
FIG. 17 is a bottom view of the D-ring connector shown in FIG. 10.
Figure 18:
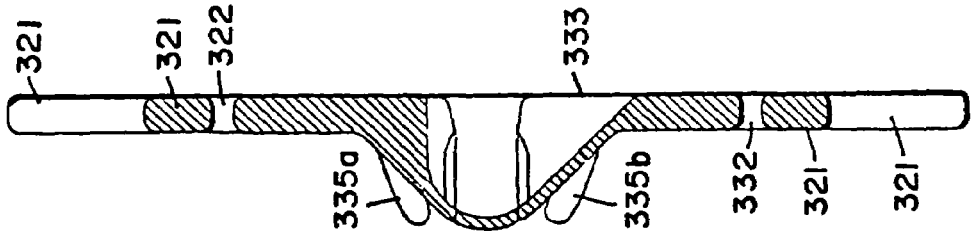
FIG. 18 is a cross-sectional view of the D-ring connector shown in FIG. 10 along the lines 18—18 shown in FIG. 17.
Figure 17A:
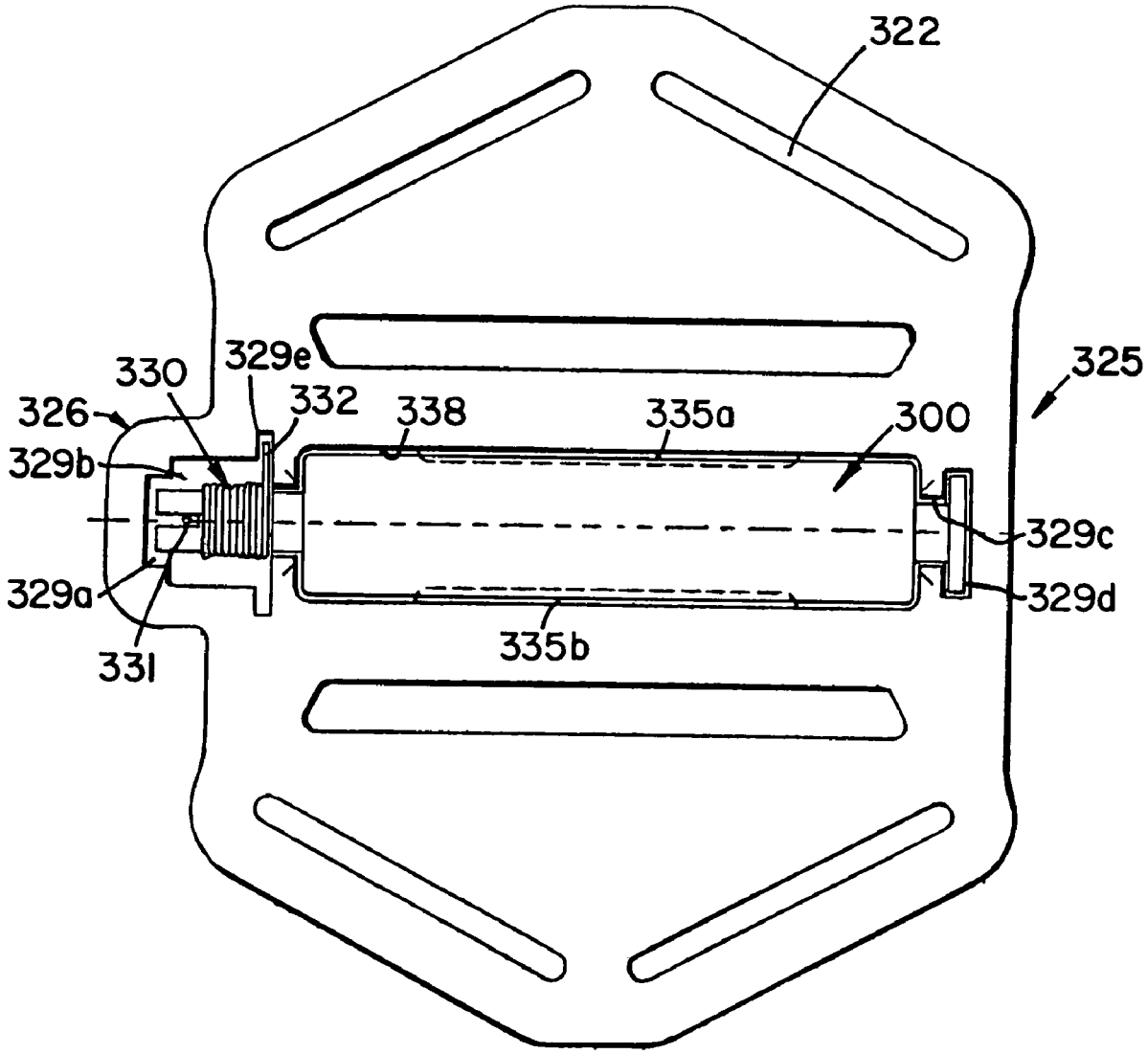
FIG. 17A is a bottom view of the D-ring connector shown in FIG. 10 with the D-ring clip and impact indicator shown in FIG. 1 and the spring shown in FIG. 9A.

The D-ring connector portion 324 extends between the two remaining sides of the dorsal pad 321 proximate the middle of the dorsal pad 321 between and parallel to the slots 323. The D-ring connector portion 324 is generally cylindrical and configured and arranged to house the D-ring clip and impact indicator 300. The D-ring connector portion 324 includes a top opening 337, a bottom opening 338, a first connecting end 325, a second connecting end 326, and a cavity 329. The top opening 337 is generally rectangular and includes a first lip 335*a* and a second lip 335*b*, which extend into the cavity 329. The bottom opening 338 is configured and arranged to receive the D-ring clip and impact indicator 300. As shown in FIGS. 17 and 17A, the first connecting end 325 is configured and arranged to accommodate the first rounded end 304 and the head 304*a* and the second connecting end 326 is configured and arranged to accommodate the second rounded end 305 and a spring 330.

Figure 9B:
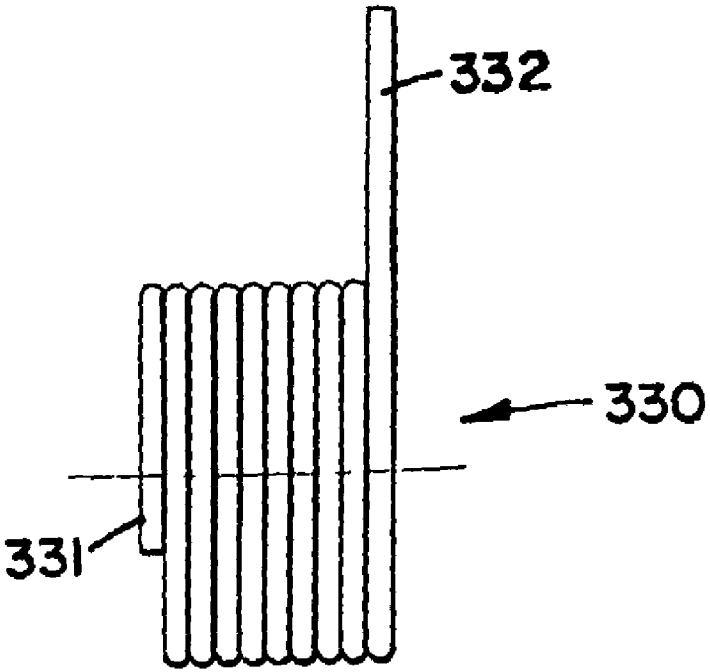
FIG. 9B is a side view of the spring shown in FIG. 9A.
Figure 9A:
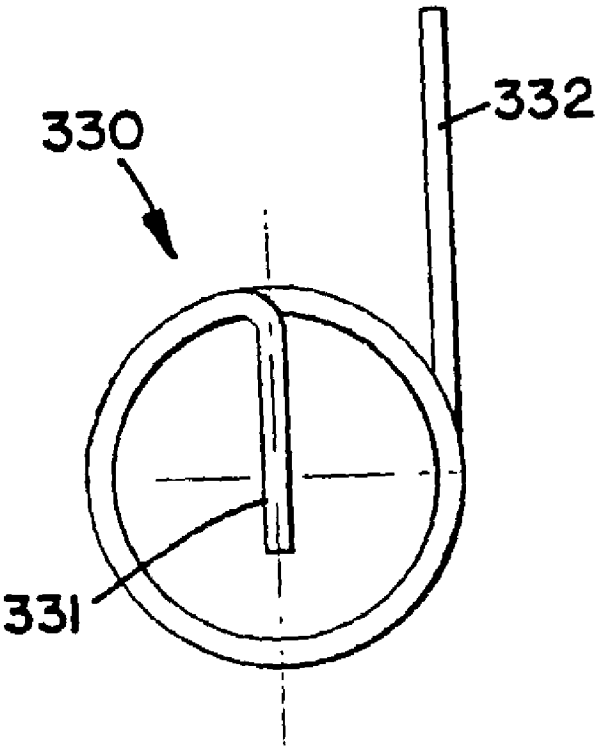
FIG. 9A is a front view of a spring for use with the combination dorsal pad, D-ring connector, and impact indicator.
Figure 10:
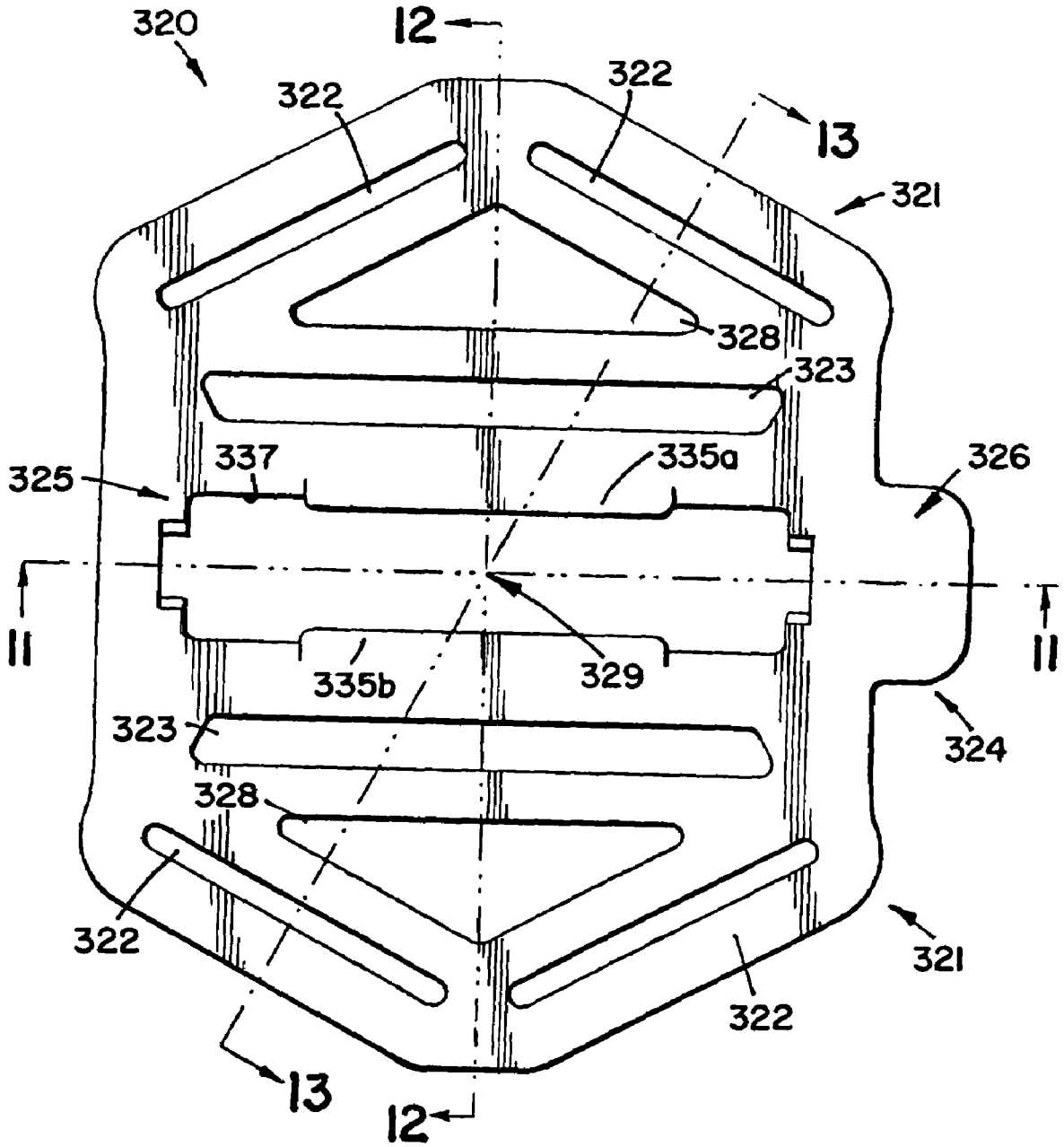
FIG. 10 is a top view of a D-ring connector constructed according to the principles of the present invention.
Figure 11:
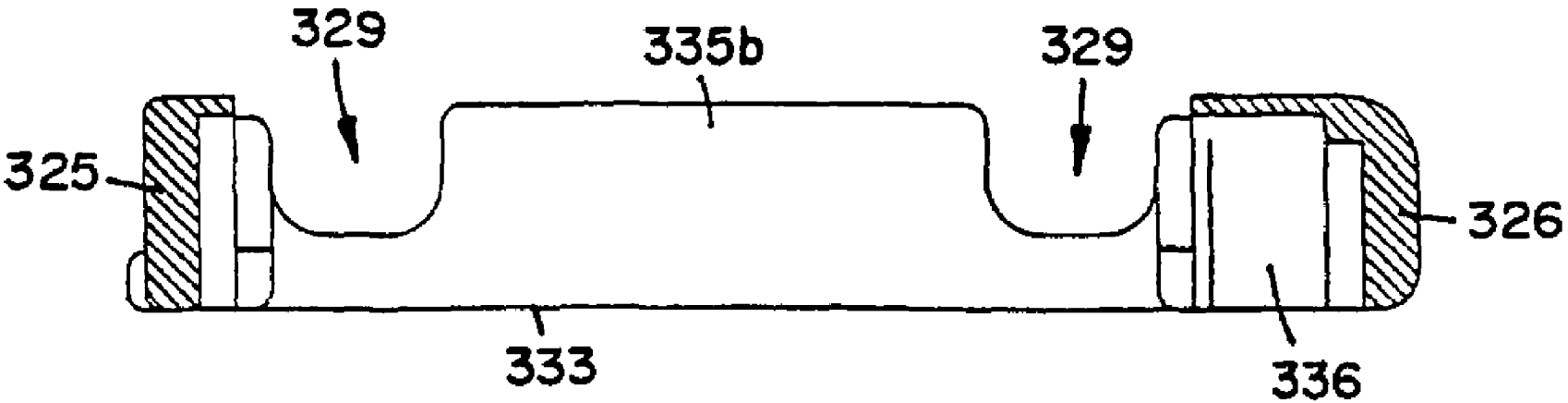
FIG. 11 is a cross-sectional view of the D-ring connector along the lines 11—11 shown in FIG. 10.
Figure 13:
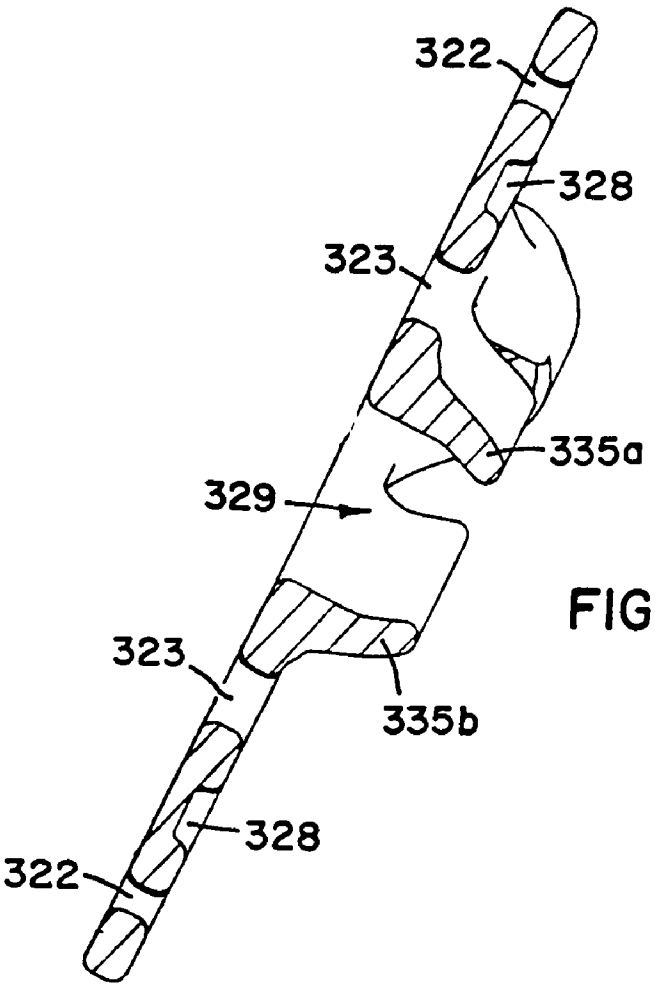
FIG. 13 is a cross-sectional view of the D-ring connector along the lines 13—13 shown in FIG. 10.
Figure 12:
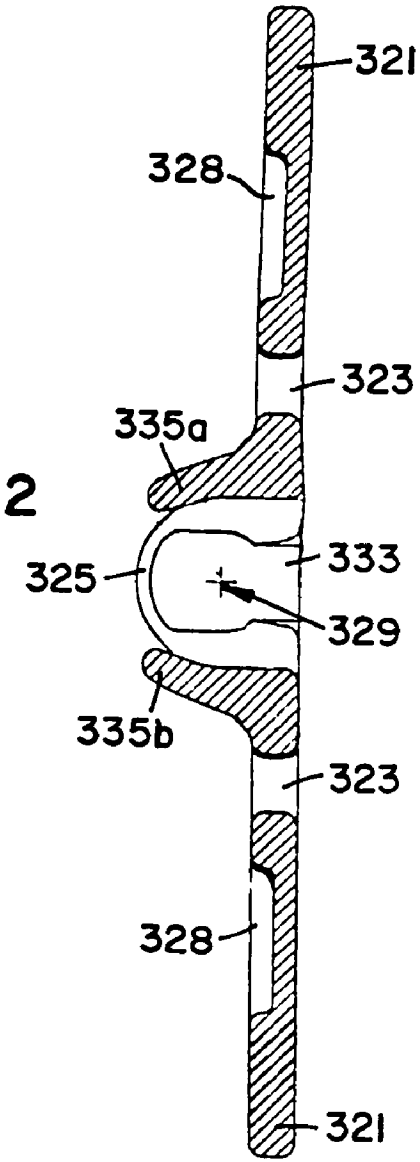
FIG. 12 is a cross-sectional view of the D-ring connector along the lines 12—12 shown in FIG. 10.
Figure 19:
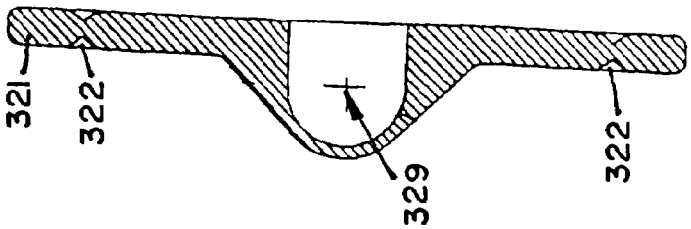
FIG. 19 is a cross-sectional view of the D-ring connector shown in FIG. 10 along the lines 19—19 shown in FIG. 17.

As shown in FIGS. 9A and 9B, the spring 330 includes a D-ring connector engaging portion 331 and a biasing portion 332. Preferably, the spring 330 is a torsion spring made of stainless steel spring wire. The biasing portion 332 should preferably extend upward from the center of the spring 330, and the D-ring connector engaging portion 331 should preferably extend downward beyond the center of the spring 330.

The top opening 337 and the bottom opening 338 of the dorsal pad 321 provide access to the cavity 329, which is configured and arranged to accommodate the D-ring clip and impact indicator 300. The cavity 329 includes a first cavity 329*a*, a second cavity 329*b*, a third cavity 329*c*, and a fourth cavity 329*d*. The first cavity 329*a* is configured and arranged to accommodate the second rounded end 305, the second cavity 329*b* is configured and arranged to accommodate the spring 330 about the second rounded end 305, the third cavity 329*c* is configured and arranged to accommodate the first rounded end 304, and the fourth cavity 329*d* is configured and arranged to accommodate the head 304*a*. Slots 329*e* extend outward proximate the side of second cavity 329*b* opposite first cavity 329*a* and are configured and arranged to accommodate the biasing portion 332 of the spring 330, although the biasing portion 332 is preferably placed within only one of the slots 329*e*.

Figure 8:
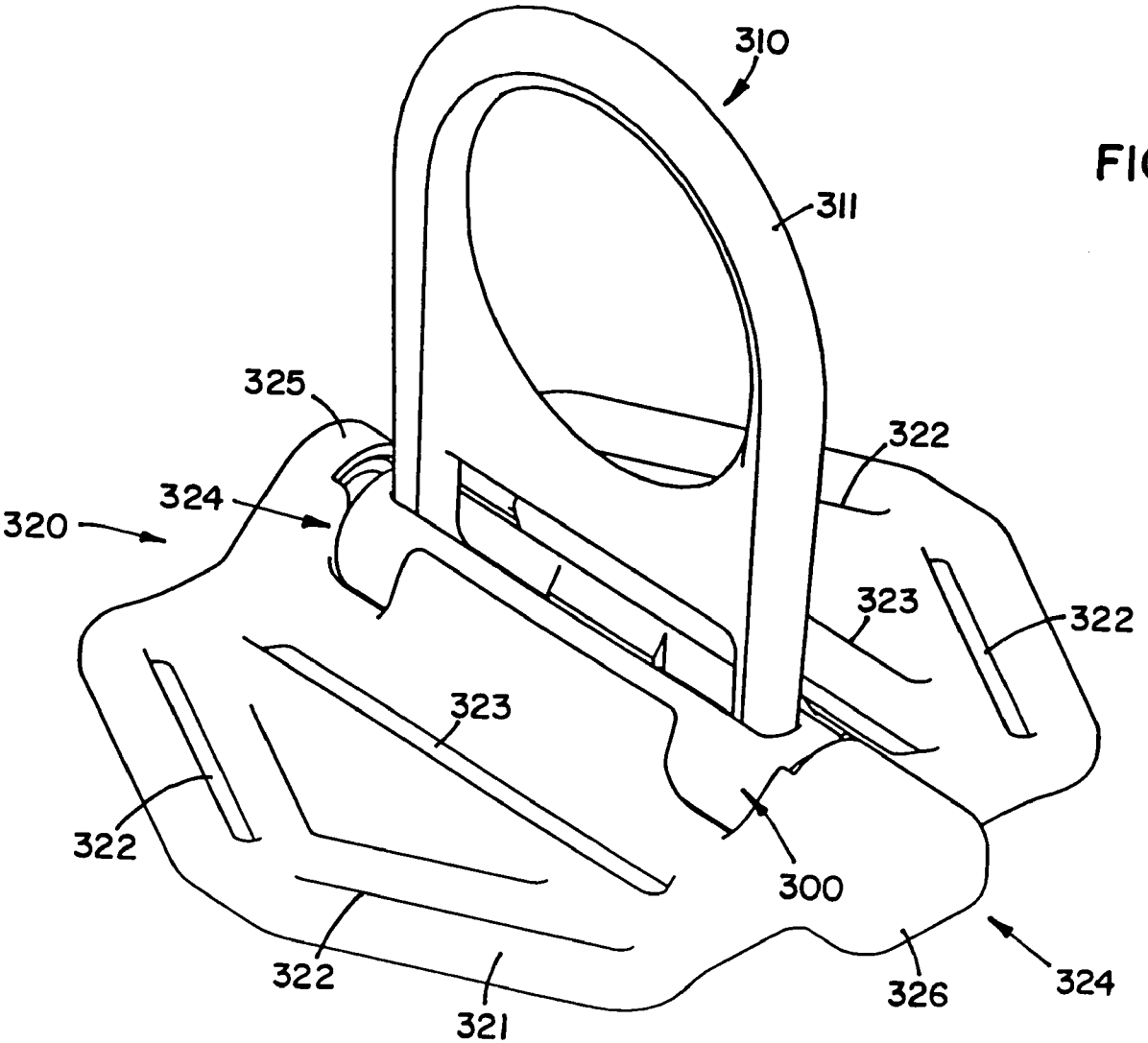
FIG. 8 is a perspective view of a combination dorsal pad, D-ring connector, and impact indicator constructed according to the principles of the present invention.

In operation, the D-ring 310 is snapped into place within cavity 302 of the D-ring clip and impact indicator 300. The D-ring connector engaging portion 331 of the spring 330 is inserted within the slot 305*a* of the second rounded end 305 so that the biasing portion 332 extends in an upwardly direction relative to the D-ring 310. When the D-ring clip and impact indicator 300 and D-ring 310 are inserted through the bottom opening 307, with the D-ring 310 being inserted first, and placed within the cavity 302, the biasing portion 332 extends in an upwardly direction within the slot 329*e* of the spring engaging end 326. The D-ring clip and impact indicator 300 interconnects the spring 330 and the D-ring 310, and the spring 330 interconnects the D-ring clip and impact indicator 300 and the dorsal pad 321. Held in place within slots 305*a* and 329*e*, the spring 330 places a constant force upon the D-ring clip and impact indicator 300 and the dorsal pad 321. The dorsal pad 321 is generally stationary and the D-ring clip and impact indicator 300 is pivotable or rotatable within the cavity 329 of the dorsal pad 321. The spring 330 urges the D-ring clip and impact indicator 300 in an upward (upright) direction relative to the dorsal pad 321 and the user. Because the D-ring 310 is operatively connected to the D-ring clip and impact indicator 300, the D-ring 310 is urged into an upright position with the D-ring clip and impact indicator 300. An upright position is the ring portion 311 of the D-ring 310 extending in an upward direction relative to the dorsal pad 321 and the user. If the D-ring 310 and the D-ring clip and impact indicator 300 are urged downward and rotate in a downward direction, the spring 330 will become coiled tighter. When the spring 330 becomes coiled tighter, the spring 330 wants to become less coiled thereby urging the D-ring 310 back into an upright position. How these components are connected is shown in FIGS. 8 and 17A.

When the D-ring clip and impact indicator 300 is inserted through the bottom opening 338 into the cavity 329, the lips 335*a* and 335*b* prevent the D-ring clip and impact indicator 300 from coming through the top opening 337. In addition, when harness straps are connected to the dorsal pad 321, the lips 335*a* and 335*b* act as a wear pad to prevent the D-ring 310 from rubbing against the straps. When the harness has been subjected to an impact, the D-ring 310 snaps out of the D-ring clip and impact indicator 300 by deflecting catches 303*a* and 303*b*, and this change in appearance provides a visual indication to the user that the safety harness should be discarded. In addition, the bar portion 312 of the D-ring 310 could include a colored portion that would become exposed when the D-ring 310 snaps out of the D-ring clip and impact indicator 300 thereby providing additional visual indication that the safety harness should be discarded. In other words, an impact indication mark, such as a colored portion on the bar portion 312 of the D-ring 310, similar to that shown in FIG. 25, may also be used to indicate an impact has occurred.

Figure 20:
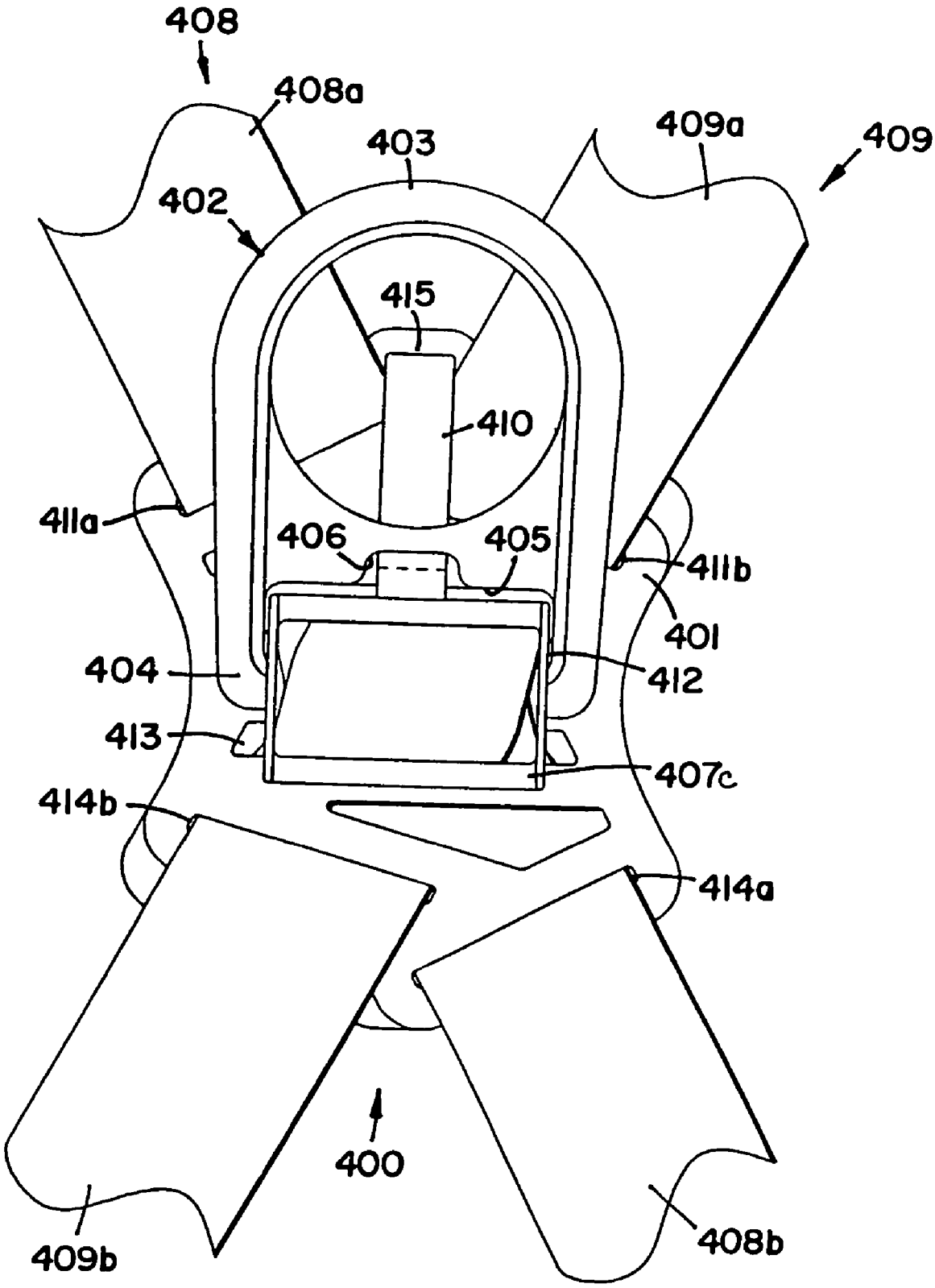
FIG. 20 is a front view of a dorsal D-ring pad assembly constructed according to the principles of the present invention.
Figure 21:
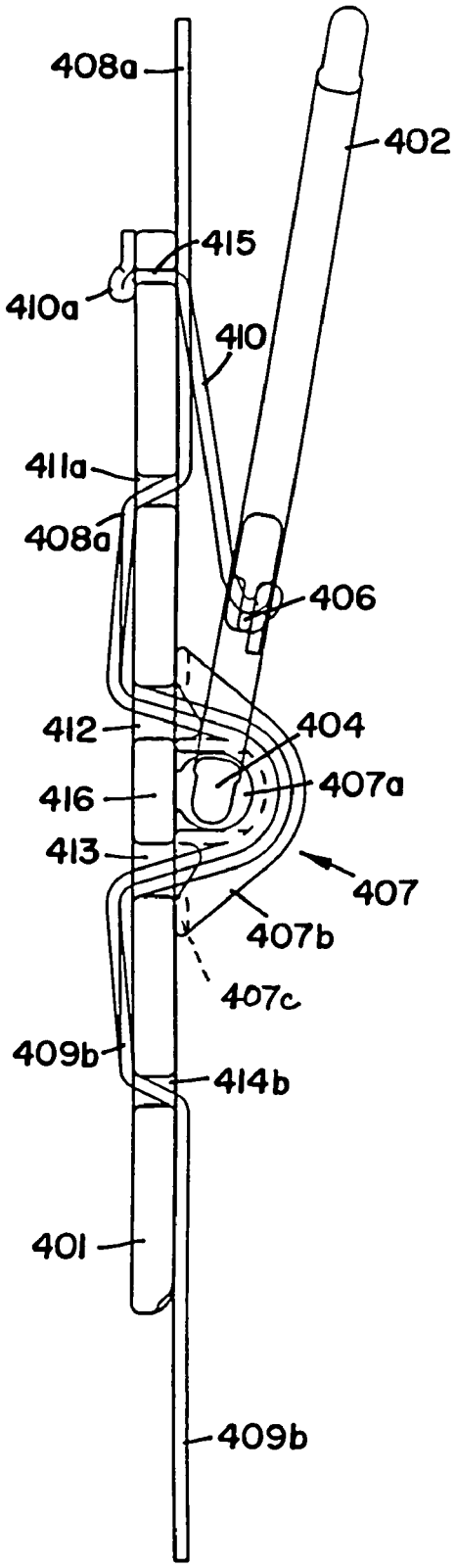
FIG. 21 is a side cross-sectional view of the dorsal D-ring pad assembly shown in FIG. 20.

FIGS. 20 and 21 show a preferred embodiment dorsal D-ring pad assembly 400 including a dorsal pad 401, a D-ring 402, and a wear pad 407. The dorsal pad 401 is similarly configured and arranged as the dorsal pad 321. The dorsal pad 401 is generally preferably hexagonal and relatively flat in shape and includes slots 411*a*, 411*b*, 412, 413, 414*a*, and 414*b*, which are configured and arranged to route straps 408 and 409 of a safety harness as is well known in the art. Slots 411*a* and 411*b* are located proximate the top, slots 412 and 413 are located proximate the middle, and slots 414*a* and 414*b* are located proximate the bottom of the dorsal pad.

The D-ring 402 includes a ring portion 403, a bar portion 404, and slots 405 and 406. The harness straps are inserted through slot 405, and an elastic strap 410 is inserted through the slots 405 and 406. Slot 406 is an additional slot than is not typically included in a D-ring but is used so the elastic strap 410 does not interfere with ring portion 403.

The wear pad 407 protects the webbing of the harness straps 408 and 409 along the bar and the side edges of the D-ring 402 proximate the bar portion 404. The wear pad 407 includes a bar protector 407*a* and a side protector 407*b*. The wear pad 407 could also include bridges 407*c* interconnecting the sides of the side protector 407*b*. The bar protector 407*a* is positioned over the D-ring 402 bar portion 404 and operatively connected to a connecting portion 416 on the dorsal pad 401. The bar protector 407*a* protects the straps 408 and 409 from rubbing against the bar portion 404 when the D-ring 402 moves during connection with a lifeline. The connecting portion 416 is preferably located proximate the middle of the D-ring pad assembly 400. For example, the bar protector 407*a* could snap into an aperture in the connecting portion 416. The bar protector 407*a* could also be connected to the connecting portion 416 with rivets, ultrasonic welding, glue, or other connecting devices well known in the art. The side protector 407*b* extends outward proximate the ends of the bar protector 407*a* and acts as a shield to protect the sides of the straps 408 and 409 from rubbing against the side edges of the D-ring 402. The wear pad 407 does not move with the D-ring 402 and therefore reduces the wear on the straps 408 and 409 as the D-ring 402 rotates. The wear pad 407 could be snapped over the D-ring 402 bar portion 404 to ensure the D-ring 402 remains in the desired position relative to the wear pad 407.

An elastic strap 410 is inserted through the slot 406 of the D-ring 402 and operatively connected to the top of the dorsal pad 401 to urge the D-ring 402 in an upright position. In other words, the elastic strap 410 is secured between the dorsal pad 401 and the D-ring 402. The elastic strap 410 could be a woven strap having an elastic stretch of 100 to 200%. It could also include a sewn or otherwise fabricated stop 410*a* operatively connected to the end(s) of the elastic strap 410 and secured at its end(s) by passing the end(s) of the elastic strap 410 through a slot 415 in the dorsal pad 401 as shown, a slot 406 in the D-ring 402, or by sewing the elastic strap 410 directly to the connecting component.

In operation, the first strap 408 is inserted through the top of slot 411*a*, through the bottom of slot 412, through the slot 405 of the D-ring 402 (under the bridges 407*c* and over the bar protector 407*a* of the wear pad 407), through the top of slot 413, and through the bottom of slot 414*a*. The dorsal pad 401 separates the strap 408 into left shoulder strap 408*a* and right back strap 408*b*. The second strap 409 is inserted through the top of slot 411*b*, through the bottom of slot 412, through the slot 405 of the D-ring 402 (under the bridges 407*c* and over the bar protector 407*a* of the wear pad 407), through the top of slot 413, and through the bottom of slot 414*b*. The dorsal pad 401 separates the strap 409 into right shoulder strap 409*a* and left back strap 409*b*. The straps 408 and 409 preferably overlap and criss-cross in divergent fashion through the dorsal pad 401.

Figure 23:
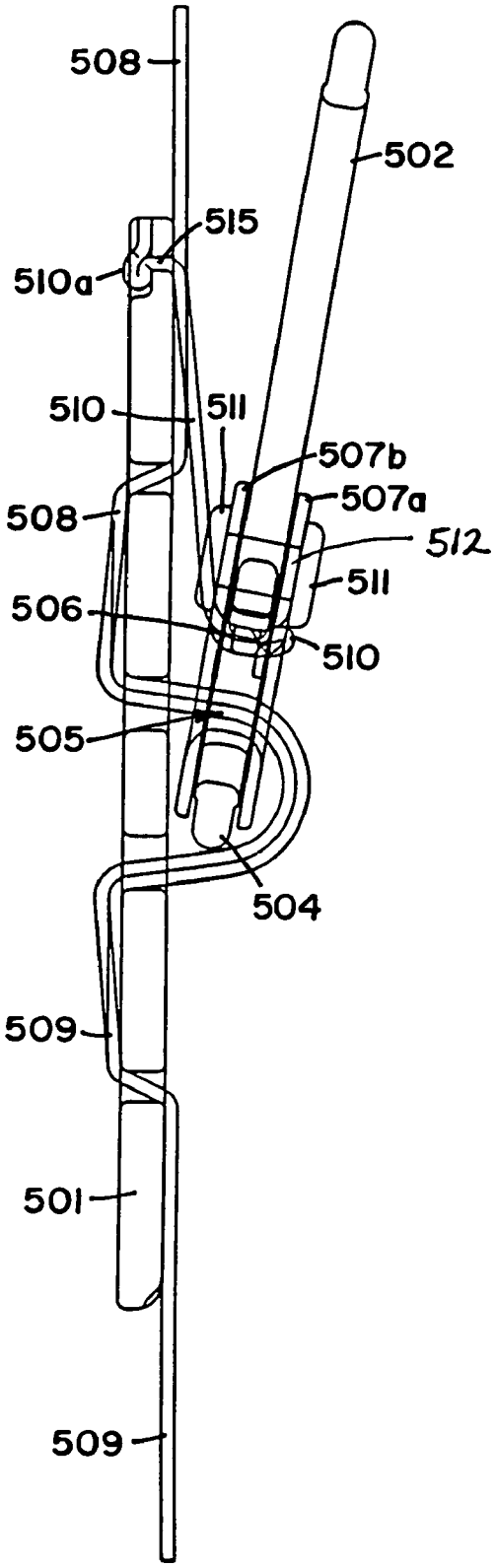
FIG. 23 is a side cross-sectional view of the dorsal D-ring pad assembly shown in FIG. 22.
Figure 22:
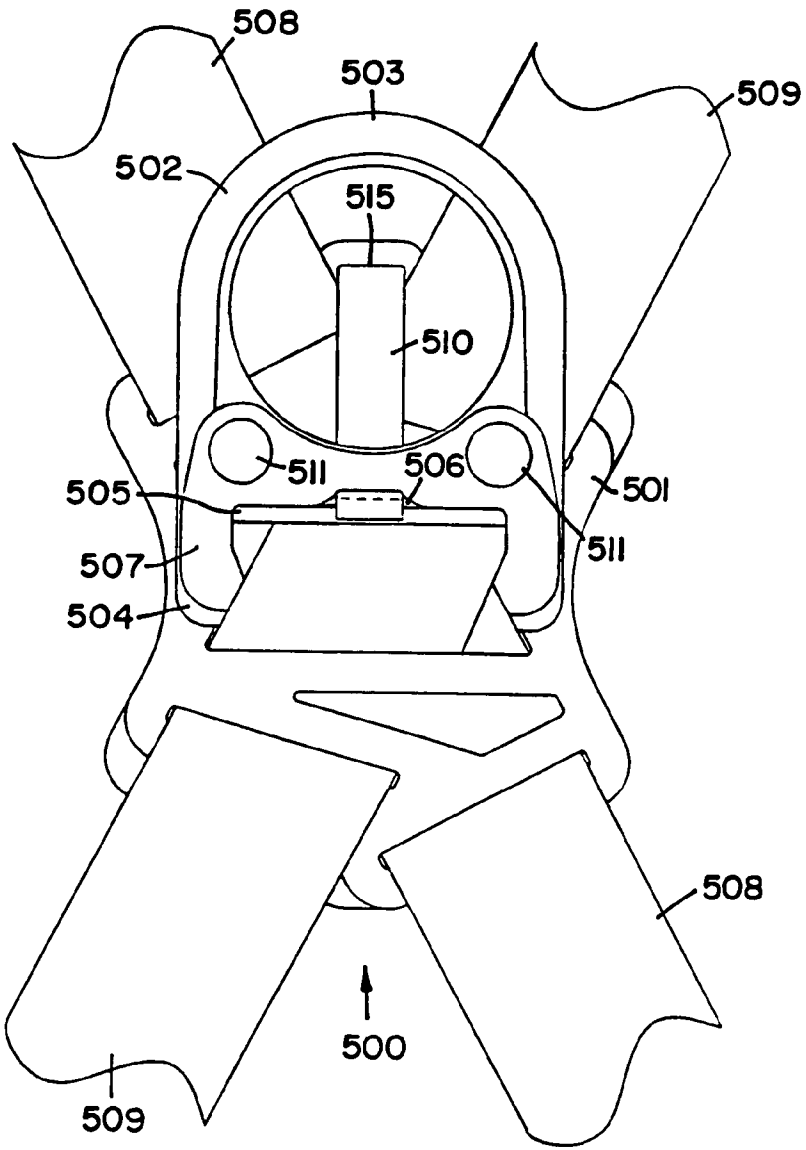
FIG. 22 is a front view of another dorsal D-ring pad assembly constructed according to the principles of the present invention.

FIGS. 22 and 23 show a preferred embodiment dorsal D-ring pad assembly 500 including a dorsal pad 501, a D-ring 502, and a wear pad frame 507. The dorsal pad 501 is similarly configured and arranged as the dorsal pad 321 and dorsal pad 401, and straps 508 and 509 are similarly routed therethrough. The D-ring 502 includes a ring portion 503, a bar portion 504, and slots 505 and 506. The harness straps are inserted through slot 505, and an elastic strap 510 is inserted through the slots 505 and 506. Slot 506 is an additional slot than is not typically included in a D-ring but is used so the elastic strap 510 does not interfere with ring portion 503.

The wear pad frame 507 includes two halves 507*a* and 507*b* joined by rivets 511 or shear members which could be separate components or incorporated into the frame 507. The frame 507 is generally the shape of the bottom portion of the D-ring 502 from the bottom of the ring portion 503 to the bottom of the bar portion 504. The frame 507 includes a slot corresponding with the slot 505 and allows for access to the slot 506 of the D-ring 502. The rivets 511 are inserted through apertures 512 in the wear pad frame 507 proximate the top of the wear pad frame 507. The wear pad frame 507 protects the webbing of the harness straps 508 and 509 along the bottom and the side edges of the D-ring 502 proximate the bar portion 504 and slot 505.

An elastic strap 510 is inserted through the slot 506 and operatively connected to the top of the dorsal pad 501 to urge the D-ring 502 in an upright position. In other words, the elastic strap 510 is secured between the dorsal pad 501 and the D-ring 502. The elastic strap 510 could be a woven strap having an elastic stretch of 100 to 200%. It could also include a plastic button or otherwise fabricated stop 510*a* operatively connected to the end(s) of the elastic strap 510 and secured at its end(s) by passing the end(s) of the elastic strap 510 through a slot 515 in the dorsal pad 501 as shown, a slot 506 in the D-ring 502, or by sewing the elastic strap 510 directly to the connecting component.

Figure 25:
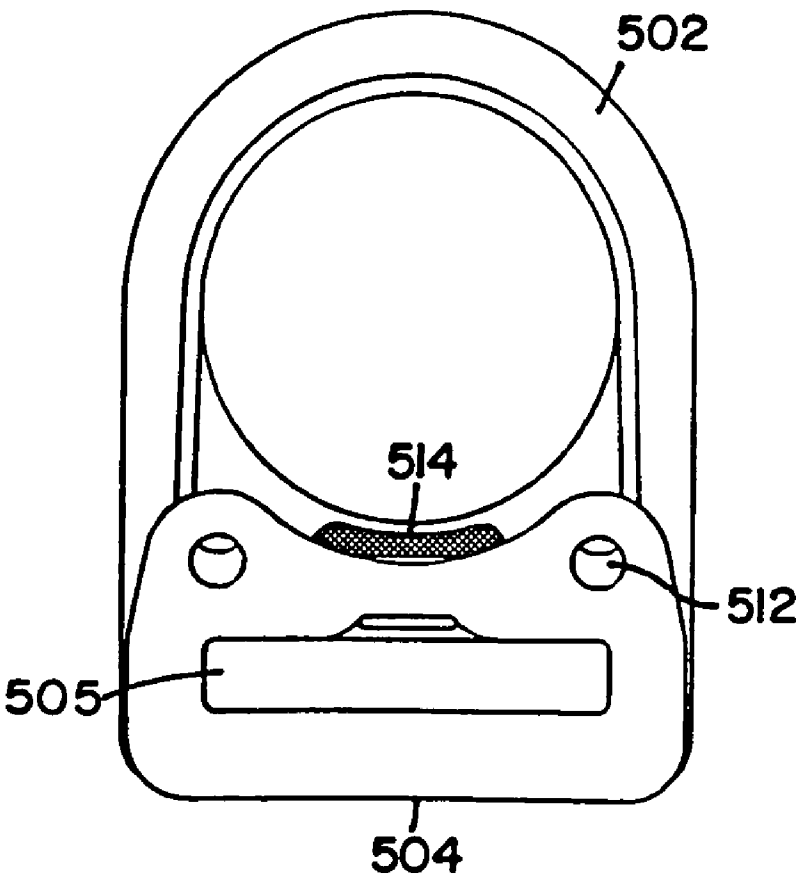
FIG. 25 is a front view of another wear pad frame and impact indicator operatively connected to a D-ring for use with the dorsal D-ring assembly shown in FIG. 22.
Figure 24:
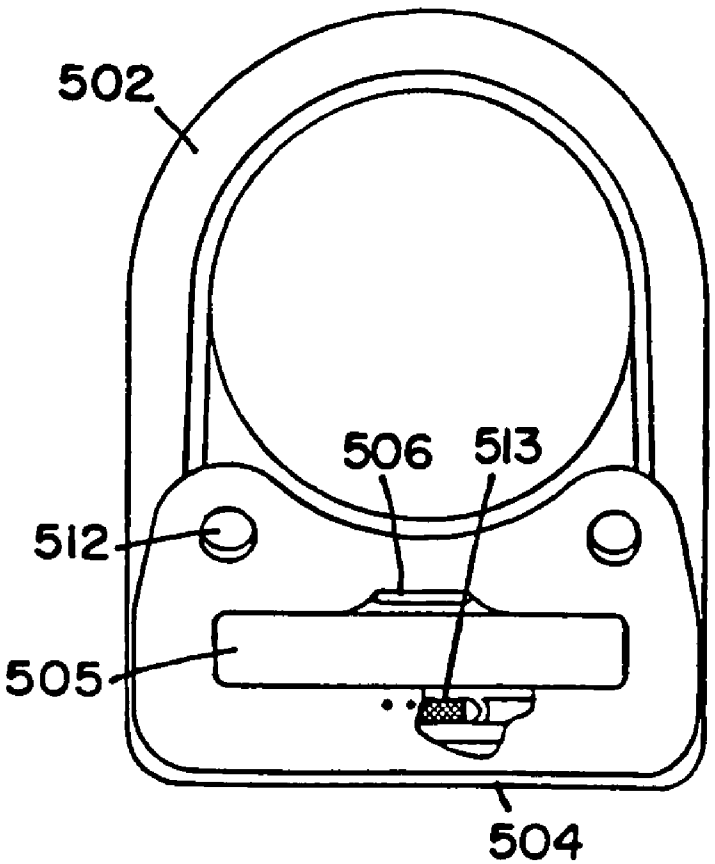
FIG. 24 is a front view of a wear pad frame and impact indicator operatively connected to a D-ring for use with the dorsal D-ring assembly shown in FIG. 22.

The dorsal D-ring pad assembly 500 could also include a fall and/or impact indicator. The wear pad frame 507 could include an ink filled pellet indicator 513, as shown in FIG. 24, or the D-ring 502 could include an impact indicator mark or flag 514, as shown in FIG. 25. The indicators 513 and 514 provide visual indication that the safety harness has been subjected to at least approximately 500 to 600 pounds of force. In addition, when the safety harness is subjected to an impact load of at least approximately 500 to 600 pounds of force, the rivets 511 could fracture and indication of the impact would be determined by the absence of the heads on the rivets 511, the wear pad frame 507 sliding relative to the D-ring 502 (possibly about 3/16 inch) revealing an indicator mark or flag on the D-ring 514, the separation of the wear pad frame 507 into two separate halves 507*a* and 507*b*, and/or the bursting of an ink filled pellet indicator 513 which would stain the harness webbing. The change in appearance would provide visual indication that the D-ring was subjected to a force of an impact.

Figure 26:
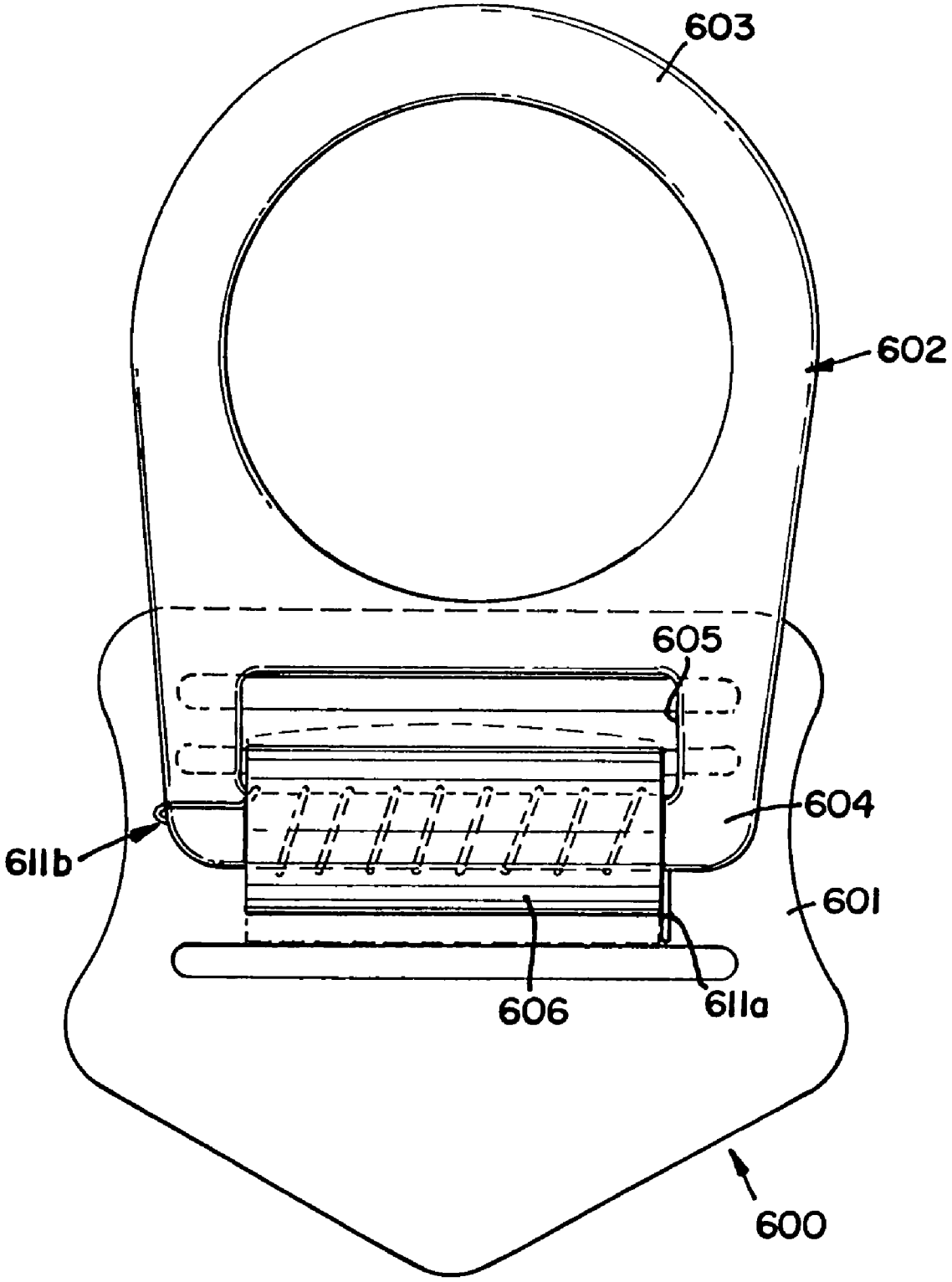
FIG. 26 is a front view of another dorsal D-ring assembly constructed according to the principles of the present invention.

FIG. 26 shows a preferred embodiment dorsal D-ring pad assembly 600 including a dorsal pad 601, a D-ring 602, and a wear pad 606. The dorsal pad 601, as shown in FIG. 28, is preferably an upside down pentagon shaped plate member and includes a first slot 612 and a second slot 614, through which straps of a harness pass, with an opening 613 therebetween.

Figure 27:
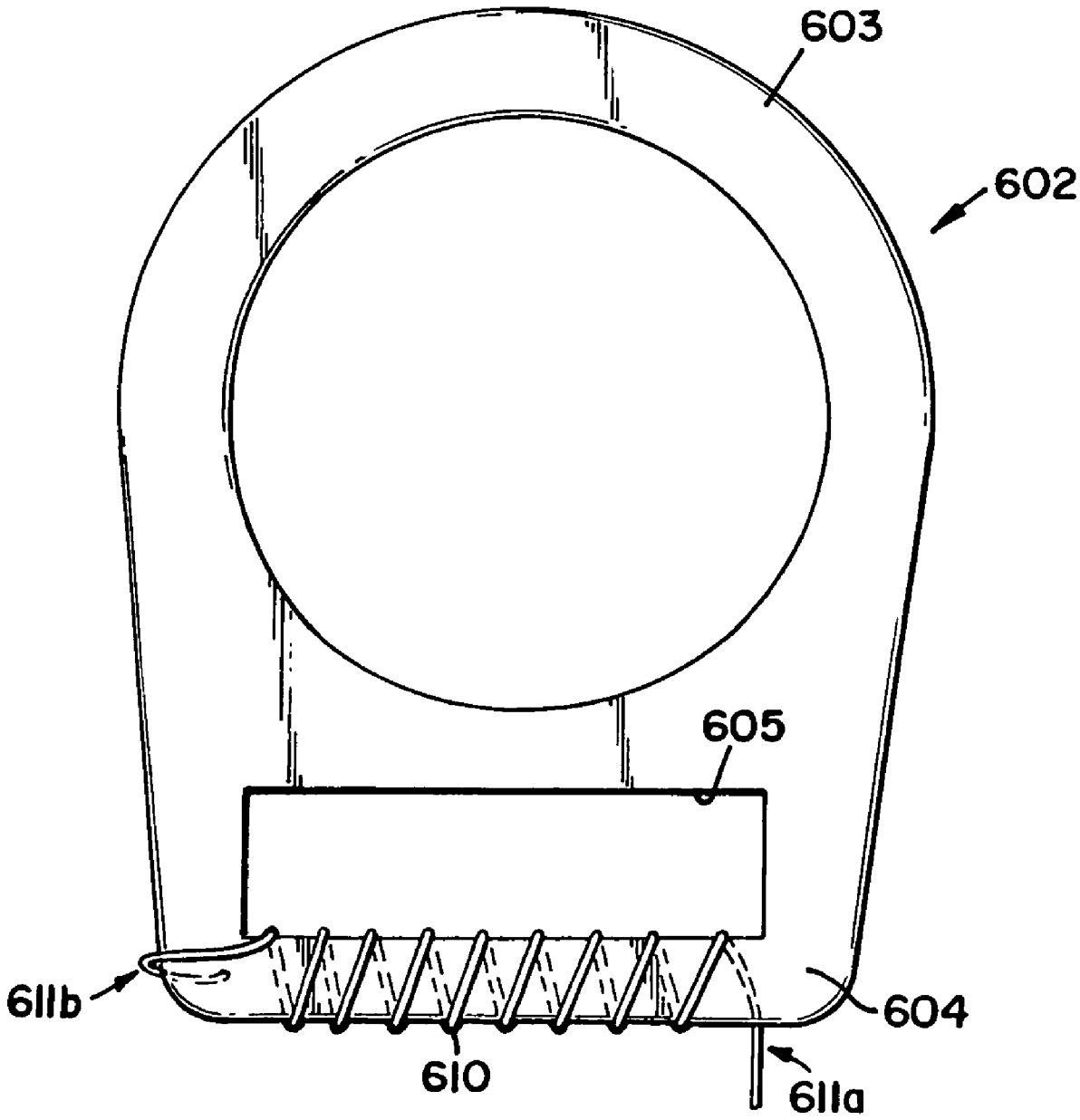
FIG. 27 is a front view of a D-ring and a spring operatively connected to the D-ring for use with the dorsal D-ring assembly shown in FIG. 26.
Figure 30:
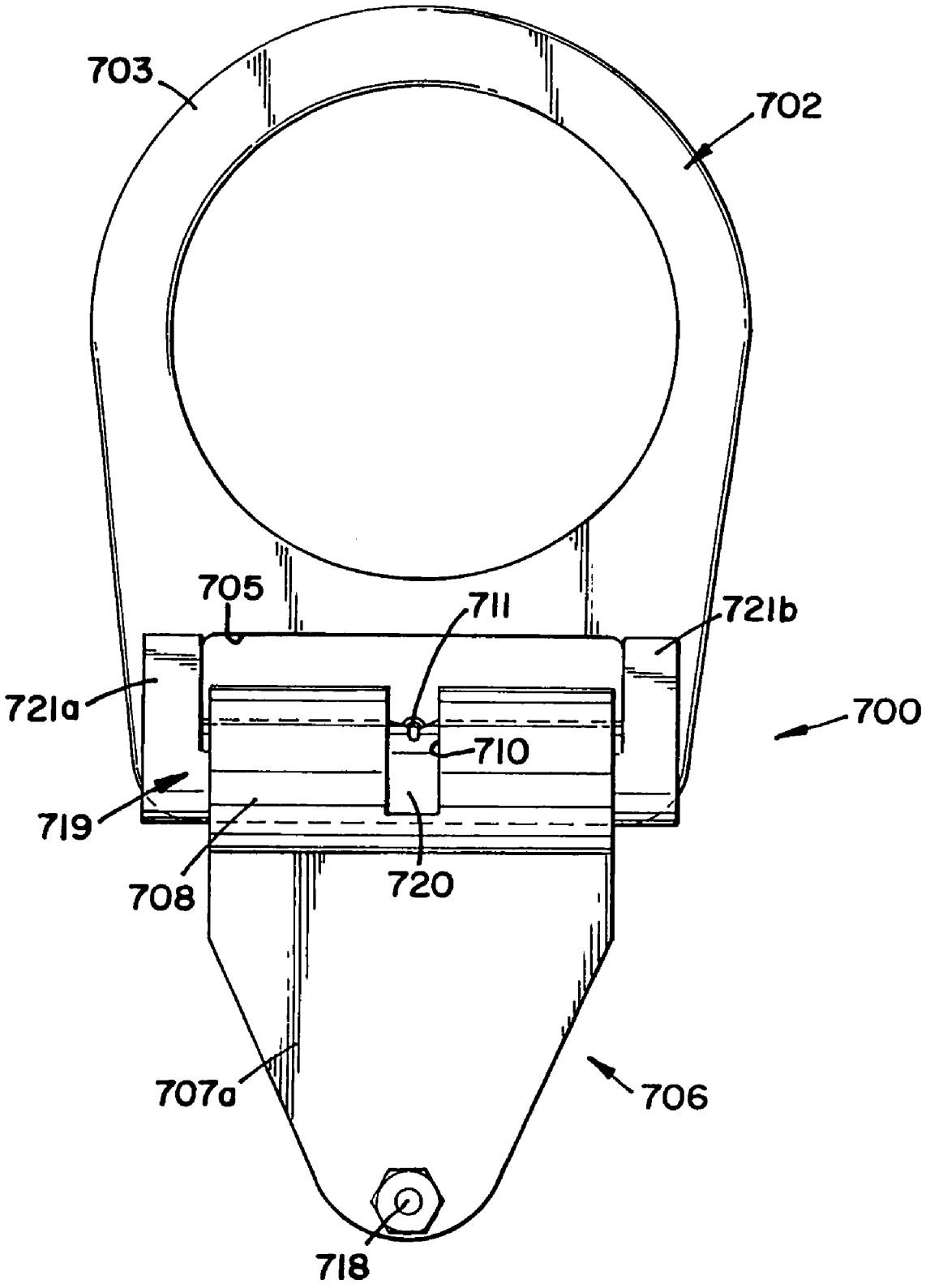
FIG. 30 is a front view of a dorsal D-ring wear pad assembly constructed according to the principles of the present invention.
Figure 31:
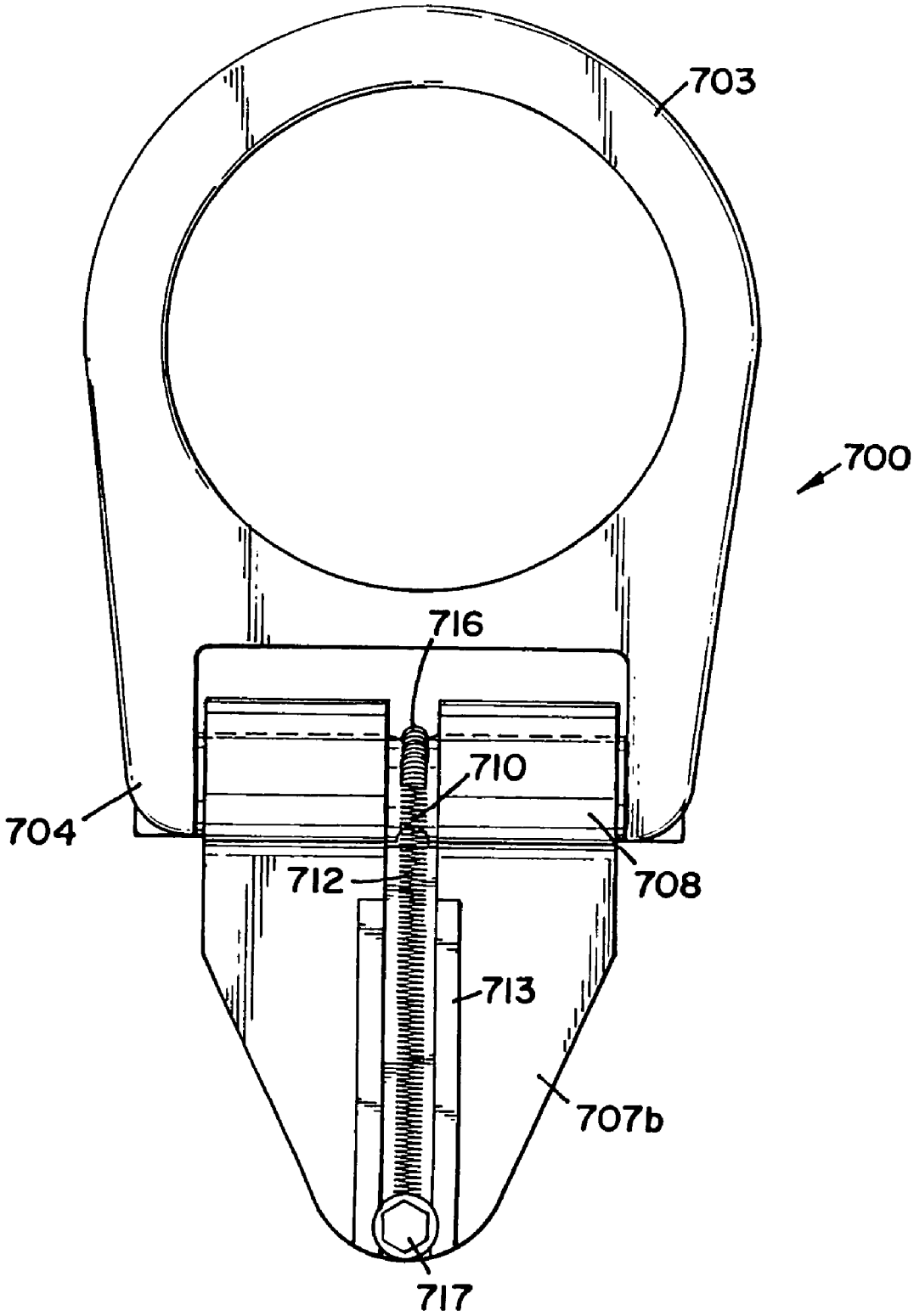
FIG. 31 is a back view of the dorsal D-ring wear pad assembly shown in FIG. 30.
Figure 32:
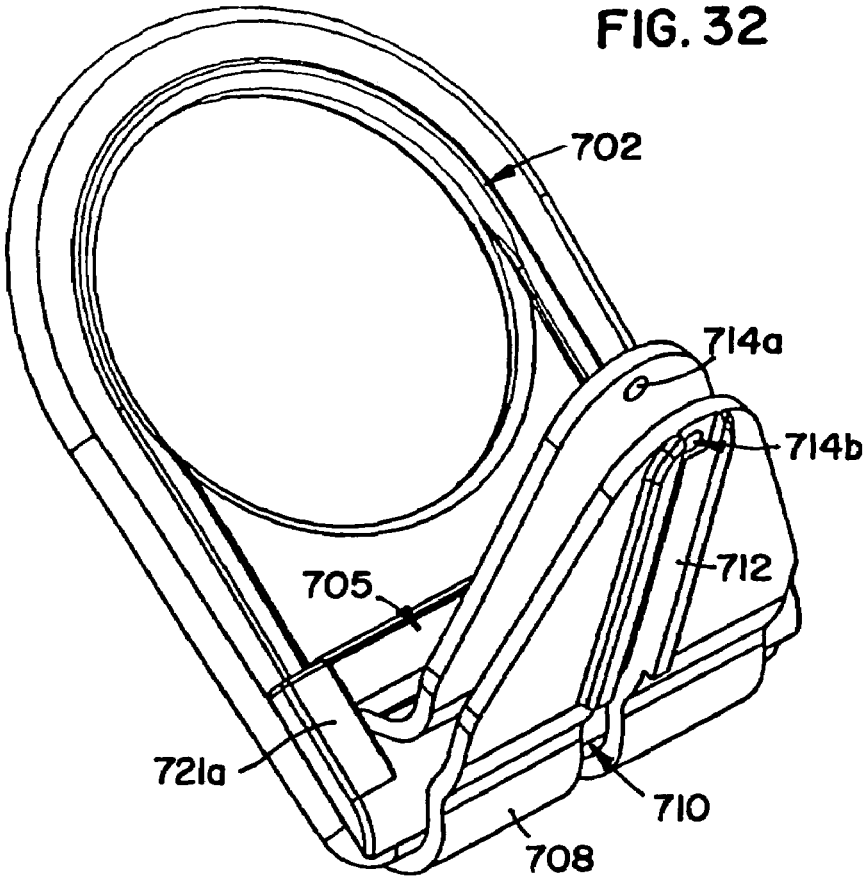
FIG. 32 is a bottom perspective view of the dorsal D-ring wear pad assembly shown in FIG. 30.
Figure 33:
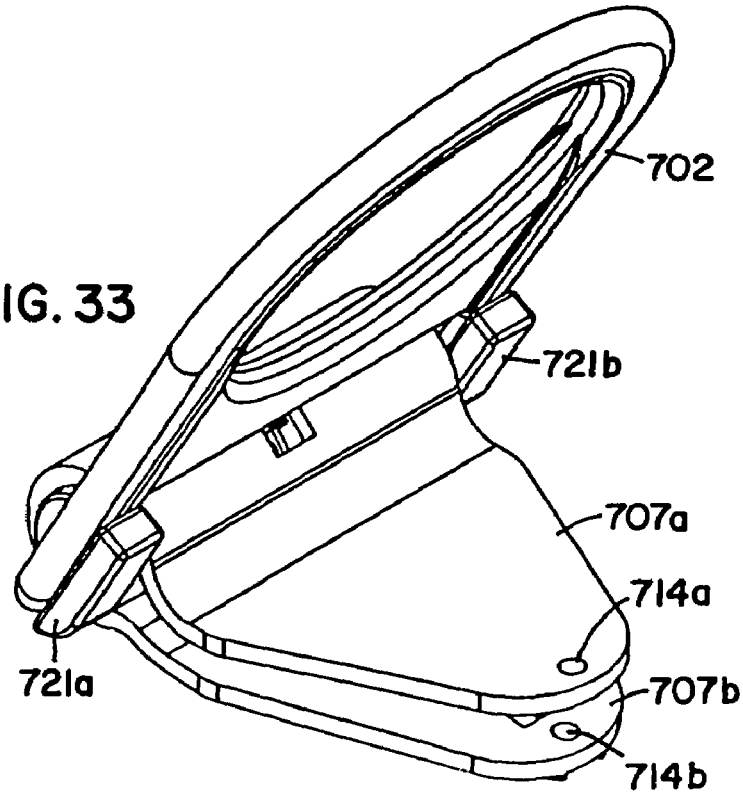
FIG. 33 is a top perspective view of the dorsal D-ring wear pad assembly shown in FIG. 30.

The D-ring 602, as shown in FIG. 27, includes a ring portion 603, a bar portion 604, and a slot 605. A spring 610 is coiled around the bar portion 604 of the D-ring 602. A first end 611*a* of the spring 610 extends downward from the bar portion 604, and a second end 611*b* of the spring 610 is wrapped around the side of the bar portion 604. The first end 611*a* provides the force required to urge the D-ring 602 in an upright position, and the second end 611*b* secures the spring 610 to the D-ring 602.

The wear pad 606, as shown in FIG. 29, is a U-shaped member having a curved base portion 607, a first lip 608*a*, a second lip 608*b*, and a cavity 609 within the curved base portion 607. The first lip 608*a* extends upward from the curved base portion 607, and the second lip 608*b* extends downward from the curved base portion 607. The second lip 608*b* is preferably longer in length than the first lip 608*a*.

In operation, bar portion 604 of the D-ring 602 including the spring 610 is inserted into the cavity 609 of the wear pad 606 with the first end 611*a* of the spring 610 facing outward from the wear pad 606, as shown in FIG. 26. The second lip 608*b* of the wear pad 606 is inserted into the opening 613 and a downward force is exerted upon the curved base portion 607 to insert the first lip 608*a* into the opening 613 thereby securing the wear pad 606 to the dorsal pad 601. The first end 611*a* of the spring 610 is positioned between the D-ring 602 and the dorsal pad 601 and keeps the D-ring 602 in an upward position. When the D-ring 602 is urged in a downward direction relative to the dorsal pad 601, the first end 611*a* pushes against the dorsal pad 601 to urge the D-ring 602 back into an upright position. The curved base portion 607 of the wear pad 606 keeps the bar portion 604 of the D-ring 602 from contacting the harness straps thereby reducing wear on the harness straps. A ledge could also be provided along the top edges of the curved base portion 607 to prevent possible contact of the sides of the D-ring 602 with the harness straps.

FIGS. 30–33 show a dorsal D-ring wear pad assembly 700 including a D-ring 702, a D-ring connector 719, and a wear pad assembly 706. The D-ring 702 includes a ring portion 703, a bar portion 704, and a slot 705 between the ring portion 703 and the bar portion 704.

Figure 34:
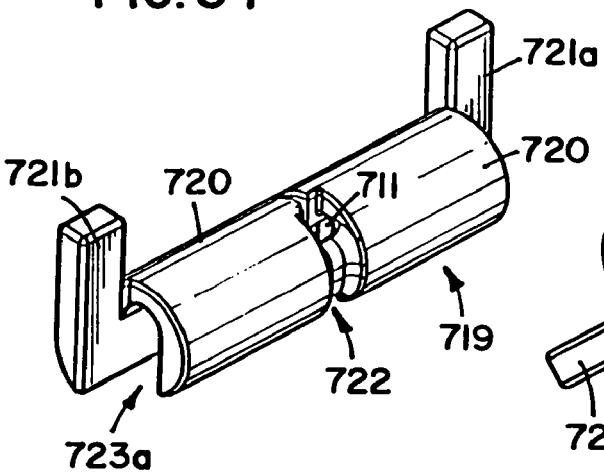
FIG. 34 is a top perspective view of a D-ring engaging portion for use with the dorsal D-ring wear pad assembly shown in FIG. 30.
Figure 35:
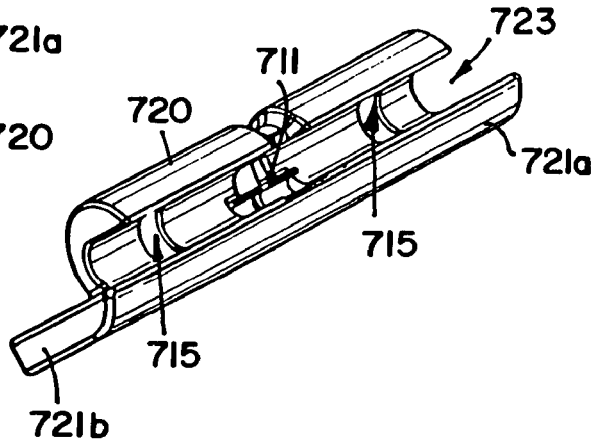
FIG. 35 is a bottom perspective view of a D-ring engaging portion for use with the dorsal D-ring wear pad assembly shown in FIG. 30.

The D-ring connector 719 includes a bar engaging portion 720, shown in FIGS. 34 and 35, which is generally cylindrical in shape and is configured and arranged to engage the bar portion 704 of the D-ring 702 within a longitudinal slot 723. When the D-ring 702 is engaged within the slot 723, the opening 723*a* of the slot 723 is preferably proximate the bottom of the D-ring 702. The bar engaging portion 720 includes ears 721*a* and 721*b* extending upward from the ends on one side of the bar engaging portion 720. The ears 721*a* and 721*b* extend upward along the sides of the slot 705 on one side of the D-ring 702. The bar engaging portion 720 also includes a lateral slot 722 proximate the middle of the bar engaging portion 720. A bar 711 extends across the slot 722 proximate the top of the bar engaging portion 720. One end of a spring 716 is operatively connected to the bar 711 and the spring 716 fits within the slot 722. In addition, the bar engaging portion 720 could include tabs 715, which act as an impact indicator, extending into the slot 723.

Figure 36:
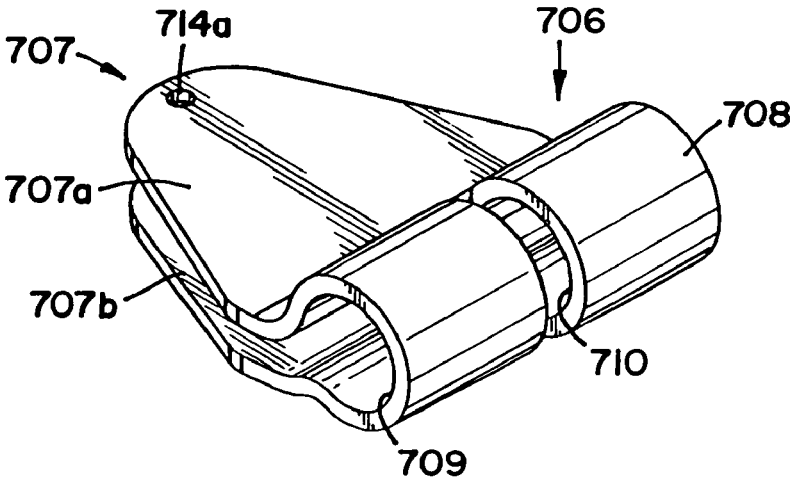
FIG. 36 is a perspective view of a wear pad assembly for use with the dorsal D-ring wear pad assembly shown in FIG. 30.

The wear pad assembly 706, shown in FIG. 36, includes a generally triangular base portion 707. The base portion 707 includes a front base 707*a* and a back base 707*b*, which are interconnected by a curved portion 708. The curved portion 708 is generally cylindrical and includes a longitudinal bore 709 and a lateral slot 710 proximate the middle of the curved portion 708. The curved portion 708 is configured and arranged to house the bar engaging portion 720 within the bore 709. The front base 707*a* and the back base 707*b* extend downward from the bottom of the curved portion 708 and each includes an aperture 714*a* and 714*b*, respectively, at the ends opposite the curved portion 708. The other end of the spring 716 is operatively connected proximate the aperture 714*b* with a fastener such as a nut 718 and a bolt 717 extending through apertures 714*a* and 714*b*. The nut 718 and the bolt 717 not only secure the other end of the spring 716 but also operatively connect the bases 707*a* and 707*b*. The back base 707*b* includes a channel 712 which extends downward from the slot 710 to the bottom of the back base 707*b*. The spring 716 is housed within the channel 712 and ribs 713 extending along the sides of the channel 712 protect the spring 716.

In operation, the D-ring 702 is inserted into the slot 123 of the D-ring connector 719. The bases 707*a* and 707*b* of the wear pad assembly 706 are separated, one on either side of the D-ring connector 719, and the D-ring connector 719 is inserted into the bore 709. Then the spring 716, which has been connected to the bar 711, is placed within the channel 712 and connected to the end of the base 707*b* via the nut 718 and bolt 717 through apertures 714*a* and 714*b* to connect the bases 707*a* and 707*b*.

Figure 38:
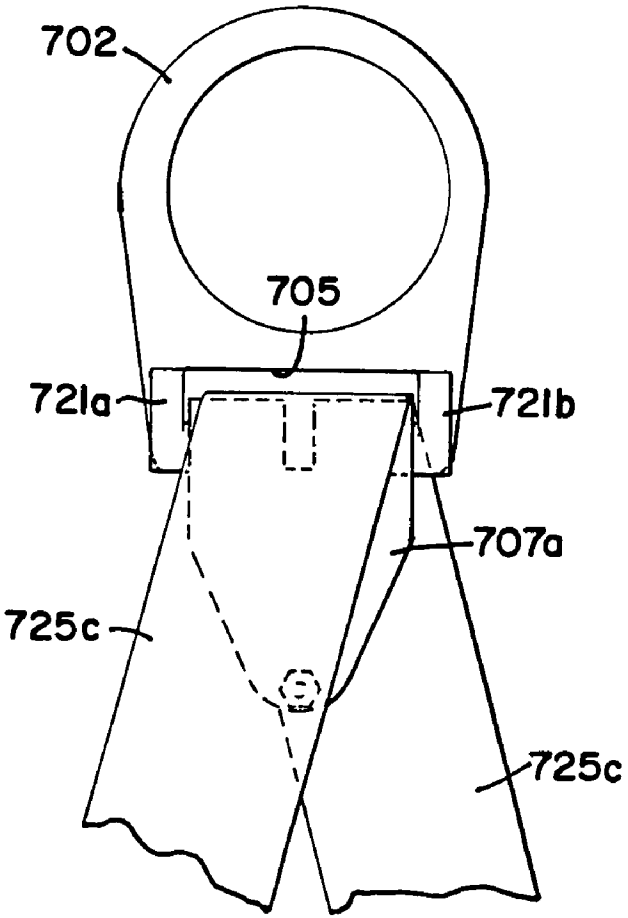
FIG. 38 is a front view of a D-ring engaging straps of a safety harness for use with the dorsal D-ring wear pad shown in FIG. 30.
Figure 37:
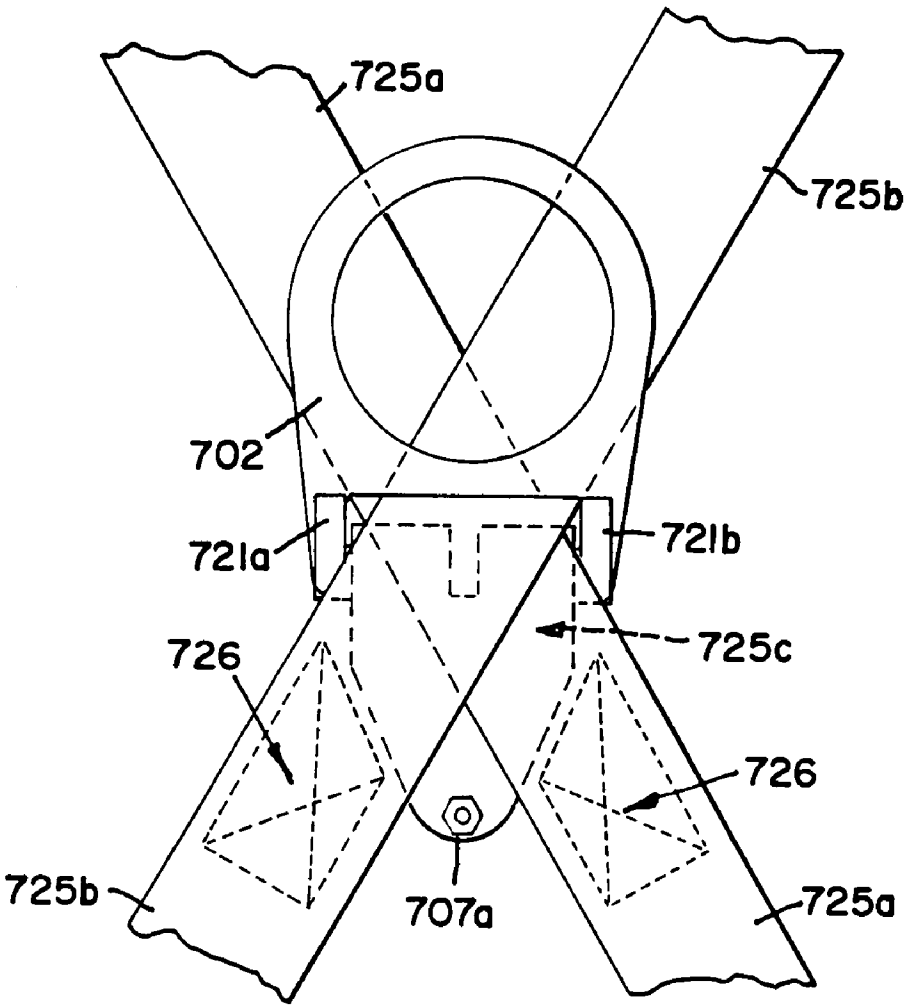
FIG. 37 is a front view of the dorsal D-ring wear pad shown in FIG. 30 engaging straps of a safety harness.

The dorsal D-ring wear pad assembly 700 is then operatively connected to a safety harness, as illustrated in FIGS. 37 and 38. The safety harness includes a first strap 725*a*, a second strap 725*b*, and a third strap 725*c*. The first and second straps 725*a* and 725*b* are threaded through the slot 705 of the D-ring 702 and preferably overlap and criss-cross in divergent fashion to form the shoulder straps and legs straps of the harness. The third strap 725*c* is attached at one end to the back of strap 725*a*, threaded through the slot 705 of the D-ring 702 over the wear pad assembly 706, and then attached at the other end to the back of the strap 725*b*. Stitching 726 may be used to attach the third strap 725*c* to the straps 725*a* and 725*b*. When assembled, the D-ring 702 extends generally in an upward direction relative to the wear pad 706 thereby extending the spring 716. The D-ring 702 and the wear pad assembly 706 are kept in place between the loop of the third strap 725*c* and the stitching 726. When thus connected, the spring 716 urges the D-ring 702 in an upright position. When the D-ring 702 is pushed in a downward direction, the spring 716 is extended and because the spring 716 wants to contract, a constant force urges the D-ring 702 in an upright position.

The curved portion 708 of the wear pad assembly 706 acts as a wear pad because as the D-ring 702 pivots, the curved portion 708 does not move with the D-ring 702. This prevents excess wear on the straps 725*a* and 725*b*. In addition, the spring 716 exerts constant force upon the D-ring 702 to ensure that the D-ring 702 remains in an upright position. Should a fall occur and/or a load is applied to the D-ring 702, the tabs 715 are crushed or collapse to expose a color under the ears 721*a* and 721*b*. The exposed color is an impact indicator visually indicating that the safety harness should be discarded.

Figure 39:
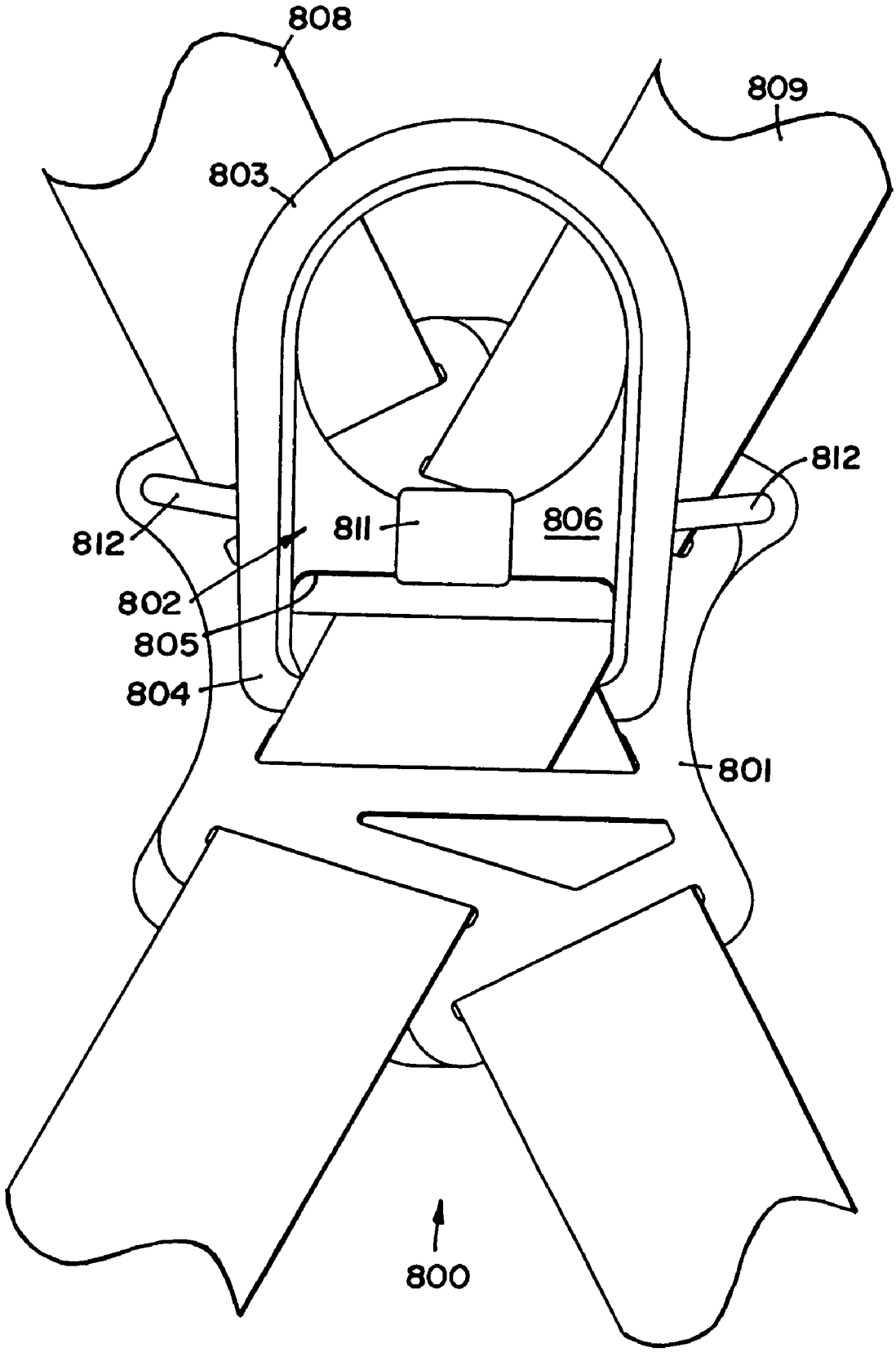
FIG. 39 is a front view of another dorsal D-ring pad assembly constructed according to the principles of the present invention.
Figure 40:
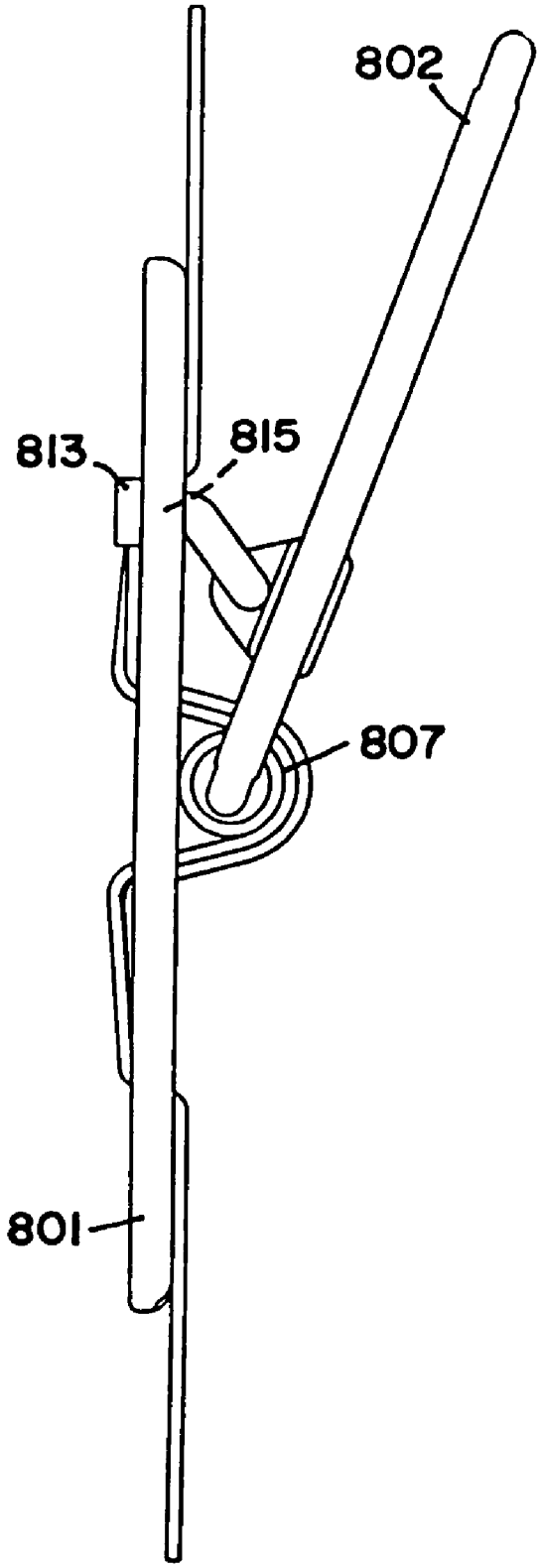
FIG. 40 is a side view of the dorsal D-ring pad assembly shown in FIG. 39.

FIGS. 39 and 40 show a preferred embodiment dorsal D-ring pad assembly 800 including a dorsal pad 801, a D-ring 802, and a wear tube 807. The D-ring 802 includes a ring portion 803, a bar portion 804, a slot 805, and an intermediate portion 806. The bar portion 804 fits within a cavity in the wear tube 807. The dorsal pad 801 is similarly configured and arranged as the dorsal pad 321 and dorsal pads 401 and 501, and the harness straps 808 and 809 are similarly threaded therethrough, being inserted through slot 805 in the D-ring 802. The wear tube 807 is preferably a cylindrical tube member about the bar portion 804 of the D-ring 802 that protects the harness straps 808 and 809 along the bottom of the D-ring 802 proximate the bar portion 804. The wear tube 807 is positioned between the D-ring 802 and the straps 808 and 809 and because the D-ring 802 moves independently within the wear tube 807, the D-ring 802 does not rub against the straps 808 and 809.

An elastic cord 812 interconnects the D-ring 802 and the dorsal pad 801 and urges the D-ring 802 in an upright position. The elastic cord 812 may be stretched to urge the D-ring 802 in a downward position, but the elastic cord 812 wants to contract to urge the D-ring 802 back into an upright position. A coupling 811 may be used to connect the elastic cord 812 to the D-ring 802, and a stop 813 may be used to connect the elastic cord 812 to the dorsal pad 801. For example, the coupling 811 could be a snap on member secured to the intermediate portion 806 of the D-ring 802. The elastic cord 812 could be inserted through an aperture 815 in the dorsal pad 801, and the stop 813 could be a knot or other fabricated securing member well known in the art. The elastic cord 812 is preferably woven or molded having an elastic stretch of 100 to 200%.

An example of a mechanism for substantially holding a D-ring 910 in an upright receiving position is shown in FIGS. 41–43. A preferred embodiment D-ring clip and fall indicator 900 includes a dorsal pad 901 having clip members 902*a* and 902*b*. The dorsal pad 901 is similarly configured and arranged as the dorsal pad 321 and dorsal pads 401, 501, and 801, and the harness straps 916*a* and 916*b* are similarly threaded therethrough, being inserted through the strap opening 915 in the D-ring 910.

The D-ring 910 includes a ring portion 911 and a bar portion 912 interconnected by connecting portions 913. The ring portion 911 includes a connector opening 914. A strap opening 915 is defined between the ring portion 911, the bar portion 912, and the connecting portions 913. An intermediate portion 918 divides the connector opening 914 and the strap opening 915. The harness straps 916*a* and 916*b* preferably criss-cross and overlap through the strap opening 915.

The clip members 902*a* and 902*b* are preferably molded to the dorsal pad 901, as shown in FIGS. 42 and 43. The clip members 902*a* and 902*b* extend outward from the dorsal pad 901 to accommodate the width and the thickness of the D-ring 910 and then extend inward to hold the D-ring 910 in an upright receiving position, as shown in FIGS. 41 and 42. It is preferred to position the clip members 902*a* and 902*b* proximate the intermediate portion 918 as to not interfere with the operation of the D-ring 910 and the safety harness. Although one clip member could be used, it is preferred to have at least two clip members, at least one on each side of the D-ring 910. It is recognized that a biasing mechanism could also be used to substantially hold the D-ring in the upright receiving position.

In operation, the D-ring 910 is held in an upright receiving position by the clip members 902*a* and 902*b*, as shown in FIG. 42. When the D-ring 910 has been subjected to a force, the D-ring 910 moves in a downward position thereby deflecting the clip members 902*a* and 902*b* outward, as shown in FIG. 43, and releasing the D-ring 910 from the clip members 902*a* and 902*b*. Because the D-ring 910 becomes disengaged by the clip members 902*a* and 902*b* and is no longer in an upright receiving position, this provides visual indication that the D-ring 910 has been subjected to a force or an impact. The D-ring could be placed in the first position again manually or by other suitable means.

It is understood that any of these features may be interchanged among the different preferred embodiments to create variations thereof and such variations are within the scope of the present invention. The above specification, examples and data provide a complete description of the manufacture and use of the composition of the invention. Since many embodiments of the invention can be made without departing from the spirit and scope of the invention, the invention resides in the claims hereinafter appended.

We claim:

1. A safety harness, comprising:

a) a first strap and a second strap;

b) a D-ring operatively connected to the straps having a first position and a second position, the first position being an upright receiving position, the second position being a connected operating position to a safety device; and c) a spring member operatively connected to the D-ring, wherein the spring member urges the D-ring to the first position.

2. The safety harness of claim 1, further comprising an impact indicator operatively connected to the D-ring, wherein the impact indicator provides indication when the D-ring has been subjected to a force.

3. The safety harness of claim 2, wherein the force is at least 500 pounds.

4. The safety harness of claim 2, wherein the impact indicator is an indication mark on the D-ring that is exposed when the D-ring has been subjected to a force.

5. The safety harness of claim 2, wherein the impact indicator is an ink filled pellet that stains the straps when the D-ring has been subjected to a force.

6. The safety harness of claim 2, further comprising a dorsal pad assembly interconnecting the straps and the D-ring.

7. The safety harness of claim 1, further comprising a wear pad operatively connected to the D-ring, the wear pad reducing wear on the straps.

8. A safety harness, comprising:

a) a first strap and a second strap;

b) a D-ring operatively connected to the straps; and c) an impact indicator operatively connected to the D-ring, the impact indicator providing indication when the D-ring has been subjected to a force.

9. The safety harness of claim 8, wherein the impact indicator is an indication mark on the D-ring that is exposed when the D-ring has been subjected to a force.

10. The safety harness of claim 8, wherein the impact indicator is an ink filled pellet that stains the straps when the D-ring has been subjected to a force.

11. The safety harness of claim 8, wherein the impact indicator is a clip member.

12. The safety harness of claim 8, further comprising a dorsal pad assembly interconnecting the straps and the D-ring, the dorsal pad assembly including the impact indicator.

13. The safety harness of claim 12, wherein the impact indicator is a change in appearance of the dorsal pad assembly thereby providing visual indication that the D-ring has been subjected to a force.

14. The safety harness of claim 12, wherein the impact indicator is a clip member.

15. The safety harness of claim 8, further comprising a biasing mechanism operatively connected to the D-ring, the D-ring having a first position and a second position, the first position being an upright receiving position, the second position being a connected operating position to a safety device, the biasing mechanism urging the D-ring to the first position.

16. The safety harness of claim 15, wherein the biasing mechanism is a spring member.

17. The safety harness of claim 15, wherein the biasing mechanism is an elastic member.

18. A safety harness having a first strap and a second strap, comprising:

a) a D-ring operatively connected to the straps having a first position and a second position, the first position being an upright receiving position, the second position being a connected operating position to a safety device;

b) means for urging the D-ring to the first position; and c) a dorsal pad assembly, the dorsal pad assembly including means for urging the D-ring to the first position.

19. The safety harness of claim 18, further comprising means for providing indication that the D-ring has been subjected to a force.

20. The safety harness of claim 19, wherein the dorsal pad assembly includes the means for providing indication that the D-ring has been subjected to a force.

21. A dorsal pad assembly for use with a safety harness having a first strap and a second strap, comprising:

a) a D-ring operatively connected to the straps having a first position and a second position, the first position being an upright receiving position, the second position being a connected operating position to a safety device;

b) a biasing mechanism operatively connected to the D-ring, the biasing mechanism urging the D-ring to the first position; and c) an impact indicator operatively connected to the D-ring, the impact indicator providing indication when the D-ring has been subjected to a force.

22. A dorsal pad assembly for use with a safety harness including straps, comprising:

a) a D-ring having a bar portion, a first position, and a second position, the first position being an upright receiving position, the second position being a connected operating position to a safety device;

b) a D-ring clip having a cavity, the bar portion of the D-ring being positioned within the cavity and being engaged by the D-ring clip;

c) a dorsal pad having slots and a D-ring connector portion, the straps of the harness being routed through the slots, the D-ring connector portion having a second cavity, the D-ring clip being positioned within the second cavity and being engaged by the dorsal pad; and d) a biasing mechanism interconnecting the D-ring clip and the dorsal pad, the biasing mechanism applying a force on the D-ring clip thereby urging the D-ring to the first position, wherein when the D-ring is placed in the second position and the biasing mechanism urges the D-ring to the first position.

23. The dorsal pad assembly of claim 22, further comprising a catch operatively connected to the D-ring clip, the catch extending into the cavity of the D-ring clip and releasably holding the bar portion of the D-ring within the cavity.

24. The dorsal pad assembly of claim 23, wherein the catch releases the bar portion when a force is exerted upon the D-ring thereby providing visual indication that the D-ring has been subjected to a force.

25. The dorsal pad assembly of claim 24, the force being at least 500 pounds.

26. The dorsal pad assembly of claim 22, further comprising lips operatively connected to the dorsal pad proximate the second cavity, the straps of the harness being routed over the lips, the lips protecting the straps from the D-ring clip as the D-ring clip pivots within the second cavity thereby reducing wear on the straps of the harness.

27. A method of securing a safety harness donned by a user to a connector of a safety device, comprising:

a) constantly urging a D-ring operatively connected to straps of the safety harness to an upright position relative to the user, the D-ring having a first position and a second position, the first position being an upright receiving position, the second position being a connected operating position to a safety device;

b) securing the connector of the safety device to the D-ring in the upright receiving position and;

c) performing tasks proximate the safety device, the D-ring being in the second position and being constantly urged to the first position.

28. The method of claim 27, further comprising disconnecting the connector from the D-ring, the D-ring returning to the first position.

29. A dorsal pad assembly for use with a safety harness having a first strap and a second strap, comprising:

a) a D-ring operatively connected to the straps having a first position and a second position, the first position being an upright receiving position, the second position being an impact indicator position; and b) a mechanism operatively connected to the dorsal pad assembly, the mechanism substantially holding the D-ring in the first position and allowing the D-ring to be in the second position when the D-ring has been subjected to a force.

30. The dorsal pad assembly of claim 29, wherein the mechanism is a biasing mechanism.

31. The dorsal pad assembly of claim 29, wherein the mechanism is a clip member.

32. The dorsal pad assembly of claim 29, wherein the second position provides indication that the D-ring has been subjected to a force.

33. A dorsal pad assembly for use with a safety harness having a first strap and a second strap, comprising:

a) a D-ring operatively connected to the straps having a first position and a second position, the first position being an upright receiving position, the second position being an impact indicator position; and b) means for substantially holding the D-ring in the first position and allowing the D-ring to be in the second position when the D-ring has been subjected to a force.

34. The dorsal pad assembly of claim 33, wherein the means is a biasing mechanism.

35. The dorsal pad assembly of claim 33, wherein the means is a clip member.

36. The dorsal pad assembly of claim 33, wherein the second position provides indication that the D-ring has been subjected to a force.

37. A safety harness, comprising:

a) a first strap and second strap;

b) a D-ring operatively connected to the straps and having a first position and a second position, the first position being an upright receiving position, the second position being a connected operating position to a safety device; and c) an elastic member operatively connected to the D-ring, wherein the elastic member urges the D-ring to the first position.

38. A safety harness, comprising:

a) a first strap and second strap;

b) a D-ring operatively connected to the straps and having a first position and a second position, the first position being an upright receiving position, the second position being a connected operating position to a safety device;

c) a biasing mechanism operatively connected to the D-ring, wherein the biasing mechanism urges the D-ring to the first position; and d) a dorsal pad assembly interconnecting the straps and the D-ring.

39. The safety harness of claim 38, wherein the dorsal pad assembly includes the biasing mechanism.

40. The safety harness of claim 39, wherein the dorsal pad assembly includes a impact indicator.

41. The safety harness of claim 40, wherein the impact indicator is a change in appearance of the dorsal pad assembly thereby providing visual indication that the D-ring has been subjected to a force.

* * * * *

UNITED STATES PATENT AND TRADEMARK OFFICE

CERTIFICATE OF CORRECTION

PATENT NO. : 7,073,627 B2
APPLICATION NO. : 10/821027
DATED : July 11, 2006
INVENTOR(S) : Casebolt et al.

It is certified that error appears in the above-identified patent and that said Letters Patent is hereby corrected as shown below:

Column 15
Line 5, “position and” should read --position; and--

Column 16
Line 32, “includes a impact” should read --includes an impact--

Signed and Sealed this

Twenty-fourth Day of April, 2007

JON W. DUDAS
*Director of the United States Patent and Trademark Office*